US011325682B2

(12) United States Patent
Lee et al.

(10) Patent No.: US 11,325,682 B2
(45) Date of Patent: May 10, 2022

(54) APPARATUS AND METHOD FOR RELIQUEFACTION OF BOIL-OFF GAS OF VESSEL

(71) Applicant: DAEWOO SHIPBUILDING & MARINE ENGINEERING CO., LTD., Geoje-si (KR)

(72) Inventors: Seung Chul Lee, Seoul (KR); Seon Jin Kim, Siheung-si (KR); Dong Kyu Choi, Busan (KR)

(73) Assignee: DAEWOO SHIPBUILDING & MARINE ENGINEERING CO., LTD., Geoje-si (KR)

( * ) Notice: Subject to any disclaimer, the term of this patent is extended or adjusted under 35 U.S.C. 154(b) by 410 days.

(21) Appl. No.: 16/338,451

(22) PCT Filed: Oct. 17, 2016

(86) PCT No.: PCT/KR2016/011657
§ 371 (c)(1),
(2) Date: Mar. 29, 2019

(87) PCT Pub. No.: WO2018/062601
PCT Pub. Date: Apr. 5, 2018

(65) Prior Publication Data

US 2019/0248450 A1 Aug. 15, 2019

(30) Foreign Application Priority Data

Sep. 29, 2016 (KR) ..... 10-2016-0125696

(51) Int. Cl.
*F25J 1/00* (2006.01)
*F17C 9/02* (2006.01)
(Continued)

(52) U.S. Cl.
CPC ..... *B63B 25/16* (2013.01); *F17C 5/02* (2013.01); *F17C 6/00* (2013.01); *F17C 9/02* (2013.01);
(Continued)

(58) Field of Classification Search
CPC .... F25J 1/0025; F25J 2210/90; F25J 2245/90; F25J 2205/02; F25J 1/009; F25J 1/0092;
(Continued)

(56) References Cited

U.S. PATENT DOCUMENTS 3,885,394 A 5/1975 Witt et al.
4,778,497 A 10/1988 Hanson et al.
(Continued)

FOREIGN PATENT DOCUMENTS

CN 204963420 U 1/2016
DE 22 35 011 A1 1/1974
(Continued)

OTHER PUBLICATIONS

K. Witt, Onboard Reliquefaction of LNG Boil-off, The Institute of Marine Engineers, Dec. 31, 1980.
(Continued)

*Primary Examiner* — Jianying C Atkisson
*Assistant Examiner* — Erik Mendoza-Wilkenfel
(74) *Attorney, Agent, or Firm* — K&L Gates LLP

(57) ABSTRACT

An apparatus for reliquefaction of boil-off gas for a vessel, comprises: a compression unit for compressing the boil-off gas discharged from the storage tank; and a heat exchanger for heat-exchanging the compressed boil-off gas compressed by the compression unit with the boil-off gas discharged from the storage tank; a first expansion means for dividing the boil-off gas passing through the heat exchanger into at least two flows including a first flow and a second flow, and expanding the divided first flow; a first intercooler for
(Continued)

cooling the second flow remaining after the division of the first flow by using the first flow expanded by the expansion means as a refrigerant; and a receiver for receiving a second flow having passed through the first intercooler, in which a downstream pressure of the compression unit is controlled by a flow discharged from the receiver.

13 Claims, 7 Drawing Sheets

(51) Int. Cl.

| | |
|---|---|
| ***B63B 25/16*** | (2006.01) |
| ***F17C 13/00*** | (2006.01) |
| ***F17C 13/02*** | (2006.01) |
| ***F17C 5/02*** | (2006.01) |
| ***F17C 6/00*** | (2006.01) |

(52) U.S. Cl.
CPC ..... *F17C 13/00* (2013.01); *F17C 13/002* (2013.01); *F17C 13/025* (2013.01); *F17C 13/026* (2013.01); *F17C 2227/0185* (2013.01); *F17C 2250/0689* (2013.01); *F17C 2265/033* (2013.01); *F17C 2265/037* (2013.01); *F17C 2265/038* (2013.01); *F17C 2270/0105* (2013.01)

(58) Field of Classification Search
CPC ..... F25J 1/0214; F25J 1/0201; F25J 1/0202; F25J 1/0203; F25J 1/0205; F25J 1/0207; F25J 1/0208; F25J 1/0209; F25J 1/021; F25J 1/0211; F25J 1/0229; F25J 1/0002; F25J 1/0022; F17C 1/002; F17C 2227/0339; F17C 2227/0358; F17C 2227/036; F17C 2227/0374; F17C 2265/033; F17C 2265/037; F17C 2265/038; F17C 2250/0689; B63B 25/16
See application file for complete search history.

(56) References Cited

U.S. PATENT DOCUMENTS

| | | | | |
|---|---|---|---|---|
| 8,256,230 | B2 * | 9/2012 | An | F25J 1/005 62/48.2 |
| 9,863,697 | B2 * | 1/2018 | Roberts | F25J 1/005 |
| 2016/0216029 | A1 * | 7/2016 | Ragot | F17C 5/06 |

FOREIGN PATENT DOCUMENTS

| | | | |
|---|---|---|---|
| EP | 2 690 274 | A1 | 1/2014 |
| JP | 2001 132899 | A | 5/2001 |
| JP | 2014-514513 | A | 6/2014 |
| JP | 2014514513 | A | 6/2014 |
| JP | 2016-061529 | A | 4/2016 |
| JP | 2016061529 | A | 4/2016 |
| JP | 2016-80279 | A | 5/2016 |
| KR | 10-2012-0133564 | A | 12/2012 |
| KR | 10-1459962 | B1 | 11/2014 |
| KR | 10-2015-0001597 | A | 1/2015 |
| KR | 10-1496577 | B1 | 2/2015 |
| KR | 101 496 577 | B1 | 2/2015 |
| KR | 2015 0039427 | A | 4/2015 |
| KR | 10-1519541 | B1 | 5/2015 |
| KR | 101 519 541 | B1 | 5/2015 |
| KR | 10-2015-0101620 | A | 9/2015 |
| KR | 10-1617022 | B1 | 4/2016 |
| RU | 2296092 | C2 | 7/2002 |
| SG | 11201808336 | S | 9/2016 |
| SU | 543360 | A3 | 1/1977 |
| WO | WO 96/22221 | A1 | 7/1996 |
| WO | WO 2007/011155 | A1 | 1/2007 |
| WO | 2015/130122 | A1 | 9/2015 |
| WO | 2017/171164 | A1 | 10/2017 |

OTHER PUBLICATIONS

Office Action in Chinese Patent Application, CN201680089668.5, dated Dec. 3, 2020.
K. Witt: "Onboard Reliquefaction of LNG Boil-off", 979 Trans. of Inst. of Marine Eng. vol. 92, No. 2, Jan. 1, 1980 (Jan. 1, 1980), pp. 22-35, XP001277355, "figure 6".
J. Romero Gomez, et al., "On board LNG Reliquefaction technology: a comparative study", Polish Maritime Research 1(81) 2014 vol. 21: pp. 77-88.
Office Action for JP 2019-513443 dated Oct. 14, 2020—4 Pages.
Search Report for EP 16 91 7802.7 dated Oct. 12, 2020—12 Pages.
Notice of Allowance of corresponding Korean Patent Application No. 10-2016-0125696—1 page (dated May 30, 2018).
International Search Report of PCT/KR2016/011657, which is parent—3 pages (dated Jun. 26, 2017).
Office Action and Search Report of corresponding Russian Patent Application No. 2019108761/12 (016847)—10 pages (dated Apr. 13, 2020).
Written Opinion of corresponding Singaporean Patent Application No. 11201902488S—7 pages (dated May 5, 2020).

* cited by examiner

APPARATUS AND METHOD FOR RELIQUEFACTION OF BOIL-OFF GAS OF VESSEL

TECHNICAL FIELD

The present invention relates to an apparatus and method for reliquefaction of BOG generated in a liquefied gas storage tank provided to a vessel.

BACKGROUND ART

Generally, natural gas is liquefied and transported over a long distance in the form of liquefied natural gas (LNG). Liquefied natural gas is obtained by cooling natural gas to a very low temperature of about −163° C. at atmospheric pressure and is well suited to long-distance transportation by sea, since the volume of the natural gas is significantly reduced as compared with the natural gas in a gaseous phase.

Liquefied petroleum gas (LPG) is also referred to as liquefied propane gas and is obtained by cooling natural gas obtained together with crude oil from oil fields to −200° C. or by compressing the natural gas at about 7 to 10 atmospheres at room temperature.

Petroleum gas is mainly composed of propane, propylene, butane, butylene, and the like. When propane is liquefied at about 15° C., the volume of propane is reduced to about 1/260, and when butane is liquefied at about 15° C., the volume of butane is reduced to about 1/230. Thus, the petroleum gas is used in the form of liquefied petroleum gas for convenience of storage and transportation.

In general, liquefied petroleum gas has a higher heating value than liquefied natural gas and contains a large amount of components having higher molecular weights than those of liquefied natural gas. Thus, liquefied petroleum gas allows easier liquefaction and gasification than liquefied natural gas.

Liquefied gas, such as liquefied natural gas, liquefied petroleum gas, and the like, is stored in a tank transferred to a demand site on land, and even when a storage tank is insulated, there is a limit to completely block external heat. Thus, liquefied natural gas is continuously vaporized in the storage tank by heat transferred into the storage tank. Liquefied natural gas vaporized in the storage tank is referred to as boil-off gas (BOG).

If the pressure in the storage tank exceeds a predetermined pressure due to generation of BOG, the BOG is discharged from the storage tank to be used as fuel for an engine or to be re-liquefied and returned to the storage tank.

In order to reliquefy BOG containing ethane, ethylene and the like as main components (hereinafter referred to as "ethane BOG") and having a low boiling point among BOG, the ethane BOG must be cooled to about −100° C. or less and thus requires additional cold heat, as compared with the case of reliquefying BOG of liquefied petroleum gas having a liquefaction point of about −25° C. Thus, a separate independent cold heat supply cycle for supplying additional cold heat is added to an LPG reliquefaction system to be used in an ethane reliquefaction process. For the cold heat supply cycle, a general propylene cooling cycle is used.

DISCLOSURE

Technical Problem

On the other hand, although there is a method for reliquefying BOG using expanded BOG as a refrigerant for compressed BOG by compressing BOG generated in a liquefied gas storage tank and expanding some of the compressed BOG, reliquefaction of ethane having a low boiling point cannot be achieved without a separate independent cold heat supply cycle, such as a propane refrigeration cycle.

However, the use of a separate independent cold heat supply cycle for reliquefaction of BOG generated in a liquefied gas storage tank, particularly ethane having a low boiling point, in a vessel including the storage tank, can cause increase in space and cost for installation (CAPEX) of the additional cycle and operation costs (OPEX) including energy consumption.

Therefore, the present invention has been conceived to solve such problems in the art and is aimed at providing an apparatus and method for reliquefaction of BOG generated from liquefied gas having a low boiling point without adding a separate independent cold heat supply cycle.

Technical Solution

In accordance with one aspect of the present invention, an apparatus for reliquefaction of boil-off gas (BOG) generated in a liquefied gas storage tank provided to a vessel includes: a compressor compressing BOG discharged from the storage tank; a heat exchanger performing heat exchange of the BOG compressed by the compressor with the BOG discharged from the storage tank, the BOG having passed through the heat exchanger being divided into at least two flows including a first flow and a second flow; a first expansion unit expanding the first flow; a first intermediate cooler cooling the second flow remaining after division into the at least two flows using the first flow expanded by the first expansion unit as a refrigerant; and a receiver receiving the second flow having passed through the first intermediate cooler, wherein pressure downstream of the compressor is controlled by the receiver.

The apparatus may further include a pressure control line regulating a pressure of the receiver by discharging a fluid from the receiver, wherein the fluid discharged through the pressure control line is returned to the liquefied gas storage tank or is discharged therefrom.

The apparatus may further include a level control line regulating a level of the receiver by discharging a fluid from the receiver, wherein at least some of the fluid discharged through the level control line is returned to the liquefied gas storage tank.

The apparatus may further include a third expansion unit disposed on the level control line and expanding the fluid returned to the liquefied gas storage tank along the level control line.

The pressure downstream of the compressor may be in the range of 40 to 100 bara.

The BOG compressed by the compressor may have a temperature of 80° C. to 130° C.

The apparatus may further include an after-cooler disposed downstream of the compressor and cooling the BOG compressed by the compressor, wherein the BOG cooled by the after-cooler has a temperature of 12° C. to 45° C.

The BOG expanded by the first expansion unit may have a pressure of 4 to 15 bara.

The apparatus may further include: a second expansion unit disposed on the level control line, the second expansion unit dividing the fluid discharged from the receiver into at least two flows including a third flow and a fourth flow and expanding the third flow; and a second intermediate cooler cooling the fourth flow remaining after division into the at least two flows using the third flow expanded by the second expansion unit as a refrigerant, wherein the fourth flow having passed through the second intermediate cooler is returned to the liquefied gas storage tank and the third flow having passed through the second intermediate cooler is supplied to the compressor.

The BOG expanded by the second expansion unit may have a pressure of 2 to 5 bara.

The compressor may be a multistage compressor including multiple compressors, and each of the first flow having passed through the first intermediate cooler and the third flow having passed through the second intermediate cooler may be supplied downstream of any one of the multiple compressors.

In accordance with another aspect of the present invention, a method for reliquefying boil-off gas generated in a liquefied gas storage tank provided to a vessel includes: compressing, by a compressor, BOG generated from the liquefied gas; cooling the compressed BOG using the BOG generated from the liquefied gas; dividing the cooled BOG into a first flow and a second flow, followed by expanding the first flow; cooling the second flow using the expanded BOG; supplying the cooled second flow to a receiver; and controlling a pressure downstream of the compressor by controlling a pressure of the receiver.

A fluid may be discharged from the receiver to be supplied to the storage tank and a fluid discharged from the receiver may be controlled to maintain an inner pressure of the receiver or the pressure downstream of the compressor at a preset pressure.

The pressure downstream of the compressor may be set in the range of 40 to 100 bara.

A fluid may be discharged from the receiver and divided into a third flow and a fourth flow, the divided third flow may be expanded to cool the fourth flow, and the cooled fourth flow may be supplied to the storage tank.

The cooled fourth flow may be expanded and supplied to the storage tank and a level of the receiver may be measured to regulate a degree of expansion of the cooled fourth flow.

The first flow may be expanded to a pressure of 4 to 15 bara, the third flow may be expanded to a pressure of 2 to 5 bara, and the expanded first flow and the expanded third flow may be supplied to the compressor after cooling the second flow and the fourth flow, and the third flow is supplied farther downstream of the compressor than the first flow.

The BOG compressed by the compressor may be cooled to 12° C. to 45° C. before heat exchange with the BOG generated from the liquefied gas.

In accordance with a further aspect of the present invention, a method for reliquefying boil-off gas generated from a liquefied gas comprising at least one selected from the group consisting of ethane, propane, and butane through natural vaporization, wherein the total amount of the BOG is reliquefied by compressing the BOG, performing heat exchange between the compressed BOG and non-compressed BOG, and expanding at least some of the compressed BOG to perform heat exchange between the expanded BOG and non-expanded BOG at least once.

The reliquefied BOG may be stored in a pressure container to control an inner pressure of the pressure container such that the compressed BOG is maintained at a preset pressure until the compressed BOG is reliquefied and stored in the pressure container.

Advantageous Effects

The BOG reliquefaction apparatus and method according to the present invention can reduce installation costs by omitting a separate independent cold heat supply cycle and is adapted to reliquefy BOG through self-heat exchange of BOG, such as ethane and the like, thereby providing the same level of reliquefaction efficiency as a typical reliquefaction apparatus even without an additional cold heat supply cycle.

In addition, the BOG reliquefaction apparatus and method according to the present invention can reduce the number of components and can omit, particularly, a compressor for a cold heat supply cycle by omitting a separate independent cold heat supply cycle, thereby reducing power consumption for operation of the cold heat supply cycle.

Further, the BOG reliquefaction apparatus and method according to the present invention includes a receiver to control pressure downstream of a multistage compressor, thereby improving refrigerating effect through achievement of an optimal coefficient of performance (COP).

BEST MODE

Hereinafter, embodiments of the present invention will be described in detail with reference to the accompanying drawings. A BOG reliquefaction apparatus and method according to the present invention may be applied in various ways to offshore systems and onshore, such as vessels with LNG cargo, particularly, all types of ships and marine structures provided with a storage tank storing low-temperature liquid cargo or liquefied gas, including ships, such as LNG carriers and liquefied ethane gas carriers, and marine structures, such as FPSOs and FSRUs.

In addition, as used herein, the term "flow" means a fluid flowing along a line, that is, boil-off gas, and a fluid in each line may be in a liquid phase, in a gas/liquid mixed phase, in a gas phase, or in a supercritical fluid phase depending upon system operation conditions.

Further, liquefied gas stored in a storage tank 10 provided to a vessel described below may have a boiling point of about −110° C. or more at 1 atm. In addition, the liquefied gas stored in the storage tank 10 may be liquefied ethane gas (LEG) or liquefied petroleum gas (LPG). In addition, liquefied gas or boil-off gas generated from the liquefied gas may include at least one component selected from the group consisting of methane, ethane, propane, butane, and heavy hydrocarbon.

Further, it should be understood that the following embodiments may be modified in various different ways and the present invention is not limited thereto.

Figure 1:
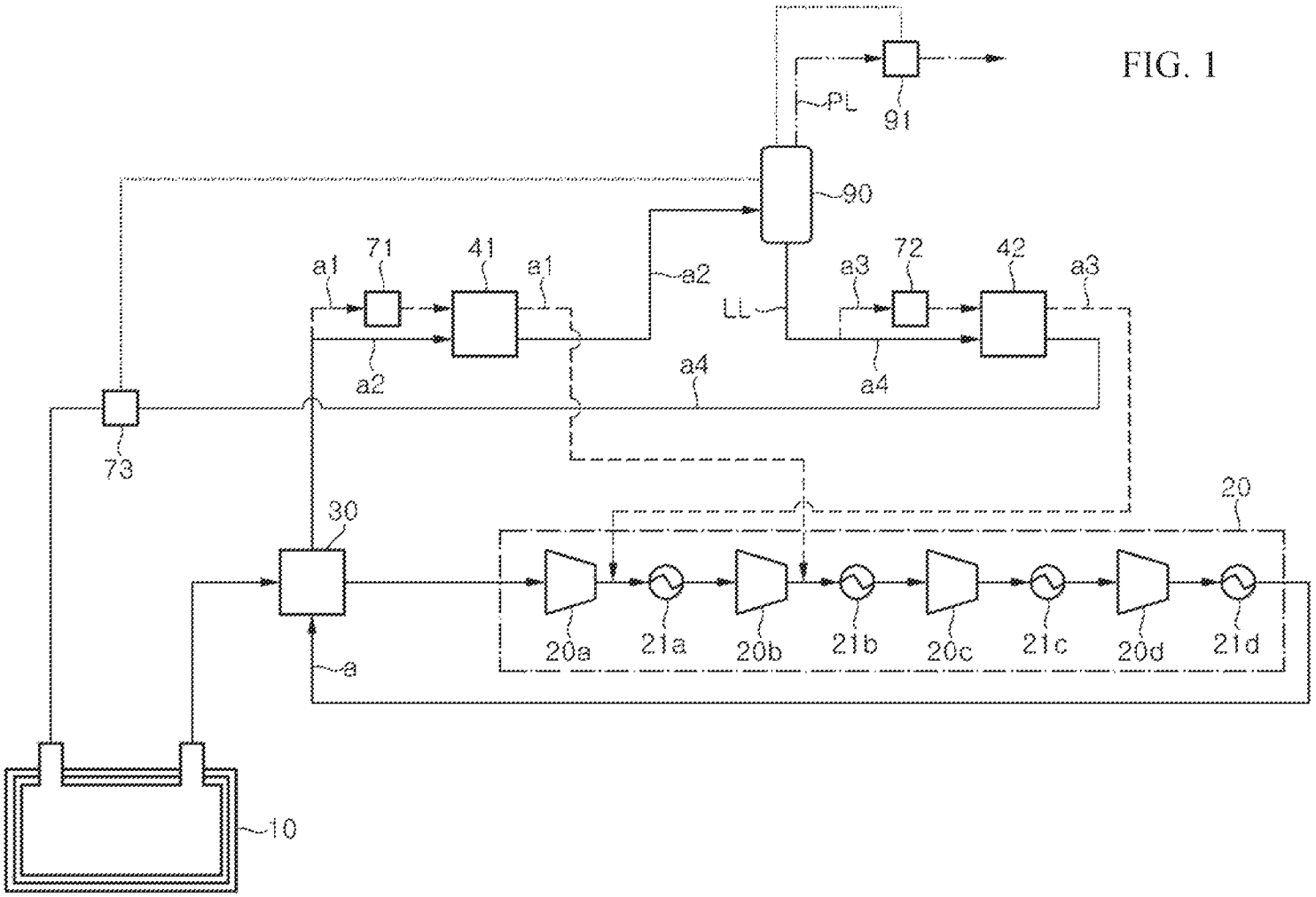
FIG. 1 is a schematic diagram of a BOG reliquefaction apparatus for vessels according to a first embodiment of the present invention.

FIG. 1 is a schematic diagram of a boil-off gas (BOG) reliquefaction apparatus for vessels according to a first embodiment of the present invention.

Referring to FIG. 1, the BOG reliquefaction apparatus according to this embodiment serves to reliquefy BOG generated in a liquefied gas storage tank 10 provided to a vessel, and includes a compressor 20 compressing the BOG discharged from the storage tank 10 and a heat exchanger 30 performing heat exchange between the BOG compressed by the compressor 20 and the BOG discharged from the storage tank 10.

According to this embodiment, the storage tank 10 discharges the BOG through a safety valve (not shown) when the pressure of the storage tank 10 reaches above a preset safety pressure due to generation of the BOG therein. The BOG discharged from the storage tank 10 is reliquefied by the reliquefaction apparatus according to this embodiment and is then returned to the storage tank 10.

According to this embodiment, the BOG discharged from the storage tank 10 is completely reliquefied by the reliquefaction apparatus according to this embodiment instead of being used as fuel for engines in the ship. Here, the total amount of the BOG is recovered in a liquid phase or partially in a gas phase to the storage tank 10, or at least some of the BOG is circulated in the reliquefaction apparatus.

According to this embodiment, the compressor 20 may be a multistage compressor 20 including multiple compressors 20*a*, 20*b*, 20*c*, 20*d*, which compress BOG through multiple stages. Herein, the multistage compressor 20 will be described as a four-stage compressor 20, which includes a first compressor 20*a*, a second compressor 20*b*, a third compressor 20*c*, and a fourth compressor 20*d*, as shown in FIG. 1.

According to this embodiment, the multistage compressor 20 compresses the BOG discharged from the storage tank 10 through multiple stages. Although the BOG is illustrated as being subjected to four-stage compression by the four compressors 20*a*, 20*b*, 20*c*, 20*d* in this embodiment, it should be understood that the present invention is not limited thereto.

The multistage compressor 20 is provided with multiple coolers 21*a*, 21*b*, 21*c* disposed between the multiple compressors to reduce the temperature of the BOG, which is increased in temperature and pressure while compressing by each of the compressors. For example, a first cooler 21*a* is disposed between the first compressor 20*a* and the second compressor 20*b* to reduce the temperature of the BOG, which is increased in temperature and pressure while compressing by the first compressor 20*a*.

Further, an after-cooler 21*d* is provided downstream of the last compressor of the multistage compressor 20, that is, downstream of the fourth compressor 20*d* in this embodiment, to regulate the temperature of the BOG compressed by the multistage compressor 20 and sent to the heat exchanger 30.

In this embodiment, the BOG compressed by and discharged from the last compressor of the multistage compressor 20, that is, the fourth compressor 20*d*, may have a pressure of 40 to 100 bara and a temperature of 80° C. to 130° C.

For example, the following Table 1 shows suction pressure and temperature of the BOG generated in the storage tank 10 and sent to each of the first to fourth compressors 20*a*, 20*b*, 20*c*, 20*d* of the multistage compressor 20, and discharge pressure and temperature of the BOG compressed by and discharged from the first to fourth compressors 20*a*, 20*b*, 20*c*, 20*d*.

TABLE 1

| | Suction | | Discharge | |
|---|---|---|---|---|
| Stage No. | Pressure (bara) | Temperature (° C.) | Pressure (bara) | Temperature (° C.) |
| First compressor 20a | 0.96 | 36.17 | 3.00 | 123.30 |
| Second compressor 20b | 2.76 | 40.00 | 9.49 | 123.60 |
| Third compressor 20c | 9.02 | 40.00 | 27.00 | 113.50 |
| Fourth compressor 20d | 26.19 | 40.00 | 83.51 | 121.50 |

That is, when BOG generated in the storage tank 10 and having a pressure of about 0.96 bara and a temperature of 36.17° C. is sent to the first compressor 20*a*, the BOG is compressed to about 3.00 bara by the first compressor 20*a* and increases in temperature to about 123.30° C. during compression. The BOG is cooled to about 40° C. in the first cooler 21*a* downstream of the first compressor 20*a* and slightly decreases in pressure to about 2.76 bara. Then, the BOG having a temperature of about 40° C. and a pressure of about 2.76 bara is sent to the second compressor 20*b*. By repetition of this process, the BOG discharged from the fourth compressor 20*a* may have a pressure of about 83.51 bara and a temperature of about 121.50° C. and may be further cooled by the after-cooler 21*d* upstream the heat exchanger 30. The BOG cooled by the after-cooler 21*d* and sent to the heat exchanger 30 may have a temperature of 12° C. to 45° C.

According to this embodiment, the heat exchanger 30 cools the BOG (hereinafter referred to as "Flow a") compressed by the multiple compressors 20*a*, 20*b*, 20*c*, 20*d* through heat exchange with the BOG discharged from the storage tank 10. That is, the BOG compressed to a higher pressure by the multiple compressors 20*a*, 20*b*, 20*c*, 20*d* is decreased in temperature by the heat exchanger 30 using the BOG discharged from the storage tank 10 as a refrigerant.

In addition, the BOG discharged from the storage tank 10 and having a low temperature decreases the temperature of Flow a through the heat exchanger 30 while being heated thereby, and is then supplied to the compressor 20*a*, 20*b*, 20*c*, 20*d*. Although it can be changed depending upon the properties of the BOG, at least some or the entirety of Flow a can be liquefied while passing through the heat exchanger 30.

Thus, according to this embodiment, since the BOG discharged from the storage tank 10 is sent to the multistage compressor 20 after being heated by the compressed BOG in the heat exchanger 30, the multistage compressor 20 including the compressors 20*a*, 20*b*, 20*c*, 20*d* can replace a cryogenic compressor adapted to compress BOG generated from a cryogenic liquefied gas and having low temperature and can prevent damage due to the BOG having low temperature.

Referring to FIG. 1, the BOG reliquefaction apparatus according to this embodiment includes a first expansion unit 71 dividing Flow a into two or more flows including a first flow a1 and a second flow a2, and expanding the first flow a1, in which Flow a has passed through the multistage compressor 20 and is discharged from the heat exchanger 30 after being cooled through heat exchange by the heat exchanger 30; a first intermediate cooler 41 cooling the second flow a2 remaining after division of Flow a using the first flow a1 expanded by the first expansion unit 71. In the first intermediate cooler 41, the second flow a2 cooled by the first flow a1 is returned to the storage tank 10 and the first flow a1 discharged from the first intermediate cooler 41 after cooling the second flow a2 is sent downstream of an intermediate terminal of the multistage compressor 20, that is, downstream of one of the multiple compressors 20*a*, 20*b*, 20*c*, 20*d* and is merged with a BOG stream generated in the storage tank 10 and compressed by the multistage compressor 20.

Referring to FIG. 1, in this embodiment, a flow passage of the BOG, which has discharged from the storage tank 10 and is compressed by the multistage compressor 20 while passing through the heat exchanger 30, the multistage compressor 20 and the first intermediate cooler 41, that is, Flow a, the second flow a2 branched off from the flow a1 and cooled by the first flow a expanded by the first intermediate cooler 41, and the BOG returned to the storage tank 10 after being cooled, super-cooled or at least partially or entirely liquefied while passing through the first intermediate cooler 41 will be referred to as a reliquefaction line, which is indicated by a solid line in FIG. 1.

In this embodiment, the first expansion unit 71 is provided to expand the first flow branched off from Flow a cooled by the heat exchanger 30 through heat exchange and discharged therefrom, and a first bypass line a1 is branched off from the reliquefaction line to provide the passage of the first flow a1.

The first expansion unit 71 expands the first flow a1 branched off from Flow a cooled by the heat exchanger 30 and the first flow a1 cooled by the first expansion unit 71 through expansion is used as a refrigerant of the first intermediate cooler 41. In this embodiment, the first flow a1 is sent to the first expansion unit 71 under conditions of about 40 to 100 bara and about 12° C. to 45° C. and is decreased in temperature while being expanded to 4 to 15 bara in the first expansion unit 71 such that the second flow a2 supplied from the first intermediate cooler 41 along the reliquefaction line under conditions of about 40 to 100 bara and about 12° C. to 45° C. can be cooled, super-cooled or at least partially liquefied by the first flow a1 expanded by the first expansion unit 71.

The second flow a2 downstream branched off from the first flow a1 and sent to the first intermediate cooler 41 along the reliquefaction line is super-cooled or at least partially liquefied in the first intermediate cooler 41 by the first flow a1 having passed through the first expansion unit 71. According to this embodiment, the entirety of the fluid sent from the first intermediate cooler 41 along the reliquefaction line may be liquefied or super-cooled depending upon the properties of the BOG.

The first flow a1 discharged from the first intermediate cooler 41 after cooling the second flow a2 is sent to the intermediate terminal of the multistage compressor 20, as shown in FIG. 1. The first flow a1 having passed through the first intermediate cooler 41 is sent downstream of a compressor having the most similar pressure to the pressure of the first flow a1 having passed through the first intermediate cooler 41, among the compressors 20*a*, 20*b*, 20*c*, 20*d* of the multistage compressor 20, and is merged with the stream of the BOG compressed by the multistage compressor 20, that is, with the reliquefaction line. Although the first flow a1 having passed through the first intermediate cooler 41 is sent downstream of the second compressor 20*b* in this embodiment, it should be understood that the present is not limited thereto.

Referring to FIG. 1, the BOG reliquefaction apparatus may further include a second intermediate cooler 42 and a second expansion unit 72 disposed on the reliquefaction line to further cool the second flow a2 having passed through the first intermediate cooler 41, and a receiver 90 described below is disposed between the first intermediate cooler 41 and the second intermediate cooler 42 such that the second flow a2 having passed through the first intermediate cooler 41 can be returned to the storage tank 10 through the receiver 90 and the second intermediate cooler 42.

In this embodiment, the second flow a2 having passed through the first intermediate cooler 41 is divided into at least two flows including a third flow a3 and a fourth flow a4, in which the third flow a3 is expanded and the fourth flow a4 is super-cooled by the expanded third flow a3 and is returned to the storage tank 10.

The second expansion unit 72 adapted to expand the third flow a3 is disposed on a second bypass line providing a flow passage of the third flow a3 branched off from the second flow a2. And the third flow a3 expanded and decreased in temperature by the second expansion unit 72 is sent to the second intermediate cooler 42 to cool the fourth flow a4 sent to the second intermediate cooler 42 along the reliquefaction line through heat exchange therewith and is then sent to the multistage compressor 20.

In addition, referring to FIG. 1, the BOG reliquefaction apparatus according to this embodiment may further include the receiver 90, which receives the second flow a2 cooled by the first intermediate cooler 41, and may further include at least one of a pressure control line PL and a level control line LL, along which the BOG is discharged from the receiver 90 and is returned to the storage tank 10.

In the BOG reliquefaction apparatus, each of the first intermediate cooler 41 and the first expansion unit 71 may be provided singularly or in plural. According to this embodiment, the BOG reliquefaction apparatus further includes the second intermediate cooler 42 and the second expansion unit 72 and thus provides, by way of example, a total of two sets of intermediate coolers and expansion units, each of which includes a single intermediate cooler and a single expansion unit. However, it should be understood that the present invention is not limited thereto in terms of the number of sets and the number of intermediate coolers or expansion units in each set.

However, with one or more intermediate coolers, that is, two sets of intermediate coolers and expansion units, the BOG reliquefaction apparatus can reduce generation of flash gas from the fluid flowing along the reliquefaction line from downstream of the receiver 90 and the first intermediate cooler 41 to the storage tank 10, thereby further improving reliquefaction efficiency.

In addition, according to this embodiment, the receiver 90 is disposed between the first intermediate cooler 41 and the second intermediate cooler 42 to receive the second flow a2 having passed through the first intermediate cooler 41 and flowing along the reliquefaction line, such that the fluid discharged from the receiver 90 along the level control line LL is branched off to the third flow a3 and the fourth flow a4, in which the expanded third flow a3 cools the fourth flow a4 remaining after division of the flow by the second intermediate cooler 42 through heat exchange and the fourth flow a4 cooled by the third flow a3 is returned to the storage tank 10.

In this embodiment, the fluid flowing along the level control line LL may be a liquid phase fluid or a super-cooled fluid.

As such, in the structure wherein the reliquefaction apparatus includes multiple sets of intermediate coolers and expansion units, the receiver 90 is disposed between an upstream set of intermediate cooler and expansion unit disposed upstream of the receiver and a downstream set of intermediate cooler and expansion unit disposed downstream of the receiver 90 to receive the fluid discharged along the reliquefaction line while supplying the fluid discharged along the level control line LL of the receiver 90 to the storage tank 10. In which the fluid supplied to the storage tank 10 along the level control line LL may be super-cooled in the downstream set of intermediate cooler and expansion unit disposed downstream of the receiver 90.

Efficiency of a fluid cooling system is represented by a coefficient of performance (COP), which indicates a ratio of refrigerating effect to compression work and is improved when the refrigerating effect is increased or the compression work is decreased.

Figure 2:
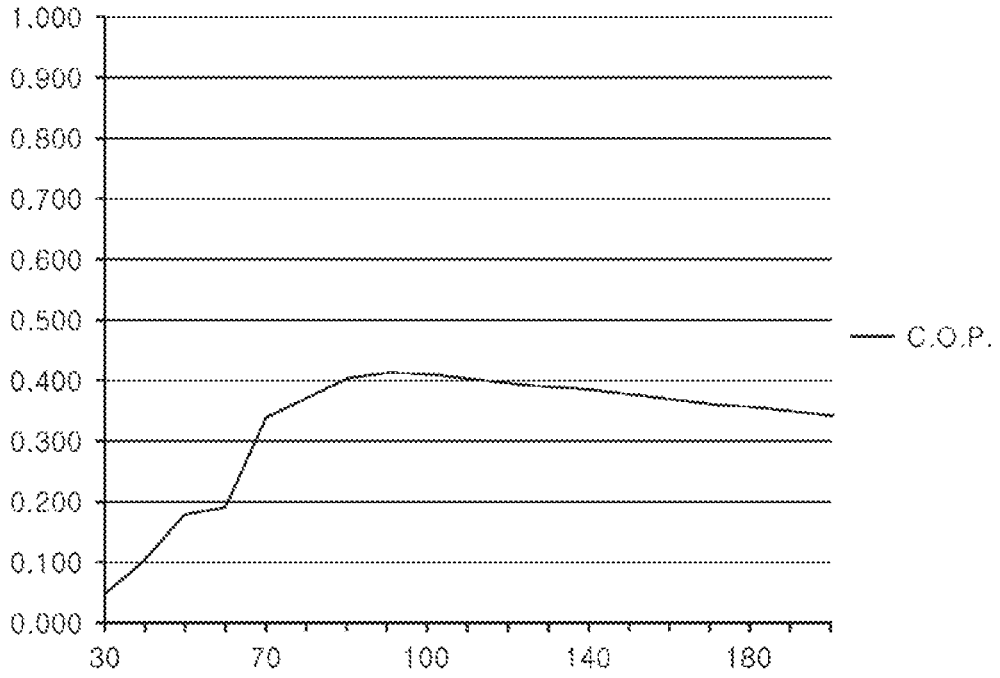
FIG. 2 is a graph depicting variation in COP of the reliquefaction apparatus according to pressure of BOG.

Referring to the graph of FIG. 2, the COP of the reliquefaction apparatus according to this embodiment (Y-axis of FIG. 2) varies depending upon pressure of the fluid flowing in the reliquefaction apparatus (X-axis of FIG. 2) and there is a pressure range providing an optimal COP. That is, according to this embodiment, the BOG reliquefaction apparatus controls the fluid, which flows along the reliquefaction line extending from downstream of the multistage compressor 20 to the first intermediate cooler 41 and the receiver 90, so as to have an optimal COP, thereby improving reliquefaction efficiency.

According to this embodiment, the receiver 90 is provided as a means for controlling the second flow a1 having passed through the first intermediate cooler 41 and returned to the storage tank 10 and enables control of pressure downstream of the multistage compressor 20 by controlling the pressure of the receiver 90.

According to this embodiment, the pressure control line PL regulating the inner pressure of the receiver 90 and the level control line LL regulating the level of the receiver 90 may be connected to the receiver 90. The fluid discharged from the receiver 90 along the pressure control line PL to regulate the inner pressure of the receiver 90 is supplied to the storage tank 10 and the fluid discharged from the receiver 90 along the level control line LL to regulate the level of the receiver 90 is subjected to heat exchange in the second intermediate cooler 42 and divided into the third flow a3, which in turn is sent to the multistage compressor 20, and the fourth flow a4, which in turn is supplied to the storage tank 10.

Although the fluid discharged from the receiver along the pressure control line PL is illustrated as being returned to the storage tank 10 in this embodiment, it should be understood that the present invention is not limited thereto. Alternatively, the fluid discharged from the receiver 90 may be discharged outside the reliquefaction system or may be circulated in the reliquefaction system.

The second flow having passed through the first intermediate cooler 41 may be in a liquid phase or may be a mixture of gas and liquid partially vaporized while flowing along the line. That is, the fluid discharged through the pressure control line PL of the receiver 90 may have a gas phase and the fluid discharged through the level control line LL of the receiver 90 may have a liquid phase. Here, the inner pressure and level of the receiver 90 may be controlled to predetermined values by the pressure control line PL and the level control line LL of the receiver 90.

The fluid discharged from the receiver 90 along the level control line LL thereof is divided into the third flow a3 and the fourth flow a4, which in turn are sent to the second intermediate cooler 42, in which the third flow a3 subjected to expansion after division of the flow cools the fourth flow a4 remaining after division of the flow through heat exchange. Then, the third flow a3 discharged from the second intermediate cooler 42 after cooling the fourth flow a4 is sent to the multistage compressor 20.

The third flow a3 is expanded to about 2 to 5 bara in the second expansion unit 72 and is then sent to the second intermediate cooler 42, in which the third flow decreased in temperature by expansion super-cools the fourth flow a4 sent to the second intermediate cooler 42 along the reliquefaction line.

As shown in FIG. 1, the third flow a3 discharged from the second intermediate cooler 42 after cooling the fourth flow a4 is sent to the intermediate terminal of the multistage compressor 20. Then, the third flow a3 having passed through the second intermediate cooler 42 is sent downstream of a compressor having the most similar pressure to the pressure of the third flow a3 having passed through the second intermediate cooler 42, among the multiple compressors 20*a*, 20*b*, 20*c*, 20*d* of the multistage compressor 20, and is merged with the stream of the BOG compressed by the multistage compressor 20, that is, with the reliquefaction line. Although the third flow a3 having passed through the second intermediate cooler 42 is sent downstream of the first compressor 20*a* in this embodiment, it should be understood that the present is not limited thereto.

Here, the third flow a3 discharged from the second intermediate cooler 42 is sent downstream of the compressor placed farther upstream than the compressor to which the first flow a1 discharged from the first intermediate cooler 41 is sent.

As shown in FIG. 1, the fourth flow a4 discharged from the second intermediate cooler 42 after heat exchange is returned to the storage tank 10 along the reliquefaction line. According to this embodiment, the reliquefaction apparatus may further include a third expansion unit 73, which is disposed downstream of the second intermediate cooler 42 to expand the fourth flow a4 having passed through the second intermediate cooler 42, and the fluid having passed through the third expansion unit 73 is supplied to the storage tank 10 in a state of being decreased in pressure and temperature by expansion.

Further, according to this embodiment, the pressure control line PL supplies the fluid discharged from the receiver 90 to the storage tank 10. In particular, the BOG returned to the storage tank 10 along the pressure control line PL may have a gas phase or a supercritical phase, and the pressure control line PL may be provided with a pressure control valve 91 which regulates opening/closing or the degree of opening of the pressure control line PL.

The pressure control valve 91 and the third expansion unit 73 may be controlled by a controller (not shown). Next, a method of controlling pressure downstream of the multistage compressor 20 in the BOG reliquefaction apparatus according to this embodiment will be described with reference to FIG. 1.

The second flow a2 discharged from the first intermediate cooler 41 along the reliquefaction line after being cooled thereby is received in the receiver 90 before being returned to the storage tank 10. The second flow a2 may have a super-cooled gas or liquid phase, a mixed phase of gas and liquid, or a supercritical phase depending upon the properties of the fluid, such as the boiling point and the like. When the second flow a2 is received in the receiver 90, a flash gas can be generated from the second flow a2 in the receiver 90, thereby causing increase in inner pressure of the receiver 90 together with a gaseous component of the second flow a2.

In this embodiment, the receiver 90 is a pressure vessel and is configured to discharge the fluid, the gaseous component and the flash gas therefrom when the inner pressure of the receiver 90 exceeds a preset value, and the fluid discharged from the receiver 90 is returned to the storage tank 91 along the pressure control line PL. The pressure control line PL may be connected to an upper portion of the receiver 90, as shown in FIG. 1.

That is, according to this embodiment, when the inner pressure of the receiver 90 reaches above a preset value, the controller can control the pressure from downstream of the multistage compressor 20 to upstream of the receiver 90 by opening the pressure control valve 91 of the pressure control line PL to allow the fluid to be discharged along the pressure control line PL. Herein, since the fluid flowing along the pressure control line PL is super-cooled while passing through the first intermediate cooler 41, the fluid supplied to the storage tank 10 along the pressure control line PL can decrease the inner temperature of the storage tank 10.

For example, when the inner pressure of the receiver 90 reaches above a preset value, the controller (not shown) opens the pressure control valve 91. When the inner pressure of the receiver 90 set to have a preset inner pressure of 80 bara is less than 80 bara, the controller closes the pressure control valve 91, and when the inner pressure of the receiver 90 is 80 bara or more, the controller opens the pressure control valve 91 such that the gas can be discharged from the receiver 90. When the pressure control valve 91 is closed, the pressure of the reliquefaction line from downstream of the multistage compressor 20 to the receiver 90 is also maintained at a level of about 80 bara. In addition, when the inner pressure of the receiver 90 exceeds 80 bara, since the pressure upstream of the receiver 90, that is, the pressure from the multistage compressor 20 to the receiver 90, cannot be maintained in a preset range by a pressure difference, the pressure control valve 91 is opened to allow the pressure of the reliquefaction line from downstream of the multistage compressor 20 to the receiver 90 to be maintained in a preset pressure range.

According to this embodiment, the pressure downstream of the compressor may be set to 40 to 100 bara, more preferably 80 bara. That is, the receiver 90 may have a preset inner pressure of 40 to 100 bara, more preferably 80 bara.

In this embodiment, when sent to the receiver 90, the second flow a2 may be in a state of being at least partially or entirely liquefied, or may be partially flashed into a flash gas before being discharged from the receiver 90.

Thus, in order to maintain the inner pressure of the receiver 90 at a preset pressure, the level of the receiver 90 is also required to be controlled. According to this embodiment, the level control line LL may be used to control the flux of the reliquefaction apparatus while controlling the level of the receiver 90.

For example, the controller (not shown) measures the level of the receiver 90 and opens the third expansion unit 73 to allow the liquid to be discharged from the receiver 90 along the level control line LL when the measured level of the receiver reaches above a preset value or more. Then, the liquid discharged from the receiver 90 is super-cooled in the second intermediate cooler 42 and is supplied to the storage tank 10 in a state of being decreased in pressure and temperature through expansion by the third expansion unit 73.

The controller controls the degree of opening of the third expansion unit 73 to control the total flux of the reliquefied BOG supplied to the storage tank 10 along the level control line LL in the reliquefaction apparatus. That is, in this embodiment, the third expansion unit 73 may be used as a means for controlling the level of the receiver 90.

In this way, according to the present invention, the fluid super-cooled while passing through the first intermediate cooler 41 is supplied to the receiver 90, and the flux of the flash gas returning from the receiver 90 to the storage tank 10 and the degree of expansion of the fluid cooled by additionally cooling the super-cooled fluid discharged in a liquid phase from the receiver 90 in the second intermediate cooler 42 are controlled while controlling the pressure or level of the receiver 90 or the pressure and level of the receiver 90, thereby improving reliquefaction efficiency of the reliquefaction apparatus.

According to this embodiment, the degree of super-cooling of the BOG sent to the third expansion unit 73 may be increased by the heat exchanger 30 in order to improve refrigerating effects.

Further, the compressed BOG is further cooled by the heat exchanger 30 and is then sent to the first intermediate cooler 41 and the second intermediate cooler 42, thereby reducing the amount of refrigerant for cooling the BOG in the first intermediate cooler 41 and the second intermediate cooler 42. Accordingly, since the amount of the refrigerant to be sent to the first and second intermediate coolers 41, 42, that is, the flux of BOG to be expanded, is reduced, the flux of BOG branched off from the reliquefaction line and sent to the multistage compressor 20 after expansion is reduced, whereby compression work of the multistage compressor 20 can be reduced while increasing the amount of reliquefied BOG in the intermediate coolers 41, 42, thereby improving the refrigerating effects.

In the structure of the reliquefaction apparatus constituted by the intermediate coolers 41, 42 together with the heat exchanger 30 and the receiver 90 without a separate refrigerating cycle as in the present invention, when the pressure downstream of the multistage compressor 20 is controlled to about 40 to 100 bara by the receiver 90, the multistage compressor 20 consumes a power of about 499.7 kW and the reliquefaction apparatus has a cooling capacity of about 241.3 kW. Thus, the reliquefaction apparatus has a cooling efficiency, that is, a COP, of about 0.48.

Comparing with this structure, assuming that BOG generated from the same liquefied gas and having the same flux and properties as those of the BOG described above, in a typical reliquefaction apparatus including a separate refrigerating cycle and free from the heat exchanger 30 according to the present invention, the multistage compressor 20 consumes a power of about 575.2 kW and the reliquefaction apparatus has a cooling capacity of about 240.3 kW. Thus, the reliquefaction apparatus has a cooling efficiency, that is, a COP, of about 0.42. That is, the reliquefaction apparatus according to the present invention can recover reliquefied BOG to the storage tank through reliquefaction of a larger amount of BOG with a smaller power.

In addition, the pressure downstream of the multistage compressor 20 is maintained at a pressure securing an optimal COP and the total flux of the BOG reliquefied by the reliquefaction apparatus is controlled to maintain the optimal COP by the receiver 90, thereby enabling maintenance of reliquefaction efficiency at the highest level.

Further, in the reliquefaction apparatus according to the present invention, the heat exchanger 30 allows most BOG generated from liquefied gas to be liquefied even without an additional refrigerating cycle. That is, when the liquefied gas is propane gas, most BOG generated from the propane gas is liquefied while passing through the multistage compressor 20, and, when the liquefied gas is ethane gas, most BOG generated from the ethane gas is liquefied while passing through the multistage compressor 20 and the heat exchanger 30. In addition, as in this embodiment, in the reliquefaction apparatus wherein the intermediate cooler is constituted by at least two intermediate coolers including the first intermediate cooler 41 and the second intermediate cooler 42, it is possible to reduce the amount of flash gas generated during a reliquefaction process in which BOG is returned to the storage tank 10 after passing through the multistage compressor 20, the heat exchanger 30, the intermediate coolers 41, 42 and the receiver 90.

Figure 3:
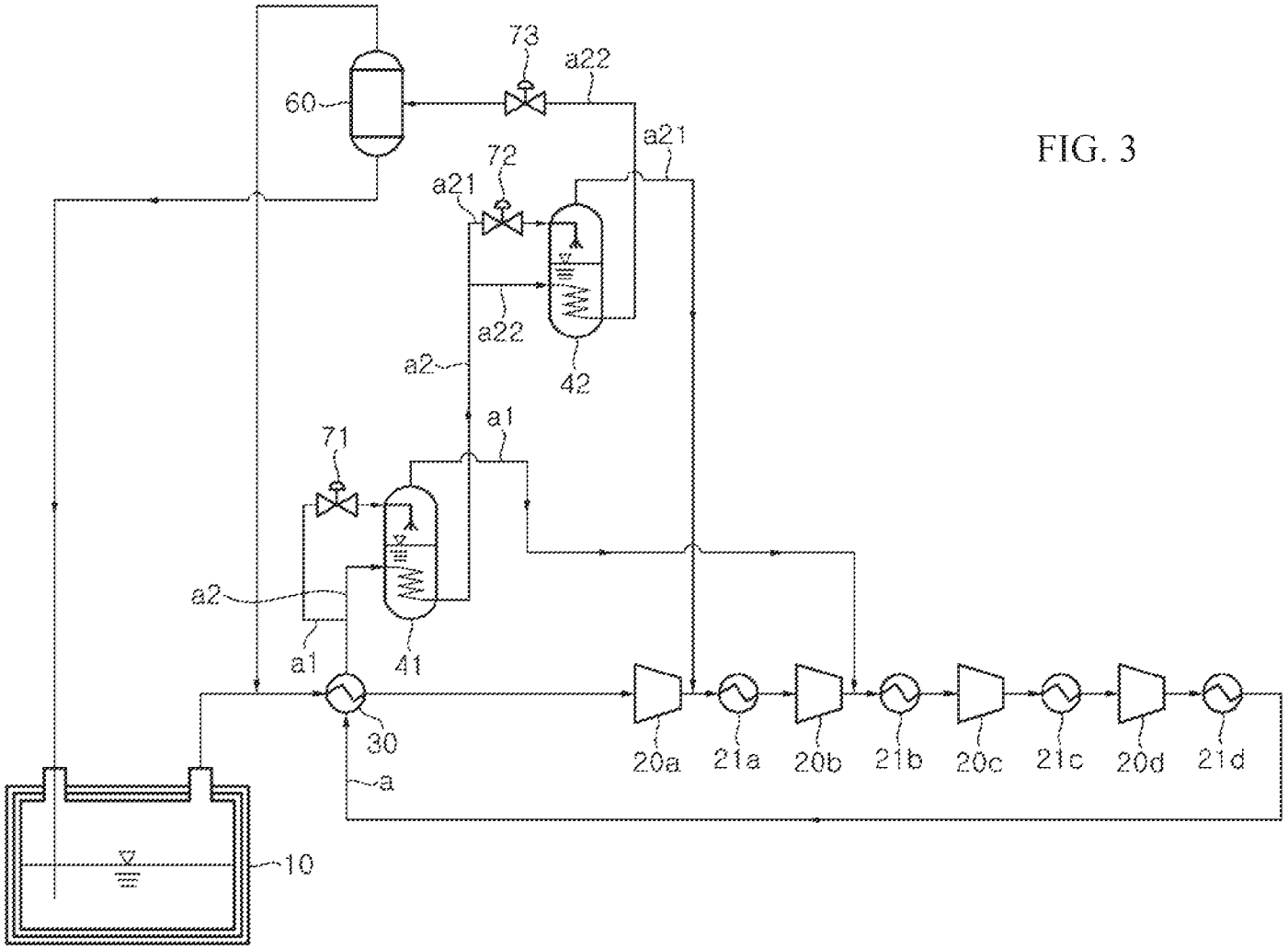
FIG. 3 is a schematic diagram of a BOG reliquefaction apparatus for vessels according to a second embodiment of the present invention.

FIG. 3 is a schematic diagram of a BOG reliquefaction apparatus for vessels according to a second embodiment of the present invention.

The BOG reliquefaction apparatus according to the second embodiment shown in FIG. 3 is distinguished from the BOG reliquefaction apparatus according to the first embodiment shown in FIG. 1 in that the BOG reliquefaction apparatus according to the second embodiment does not include the receiver, the pressure control line and the level control line, and the following description will focus on the different features of the BOG reliquefaction apparatus according to the second embodiment. Detailed description of the same components as those of the BOG reliquefaction apparatus according to the first embodiment will be omitted herein.

Referring to FIG. 3, the BOG reliquefaction apparatus according to this embodiment includes: multiple compressors 20*a*, 20*b*, 20*c*, 20*d* compressing BOG discharged from a storage tank 10 through multiple stages; a heat exchanger 30 performing heat exchange between the BOG compressed by the multiple compressors 20*a*, 20*b*, 20*c*, 20*d* through multiple stages and the BOG discharged from the storage tank 10; a first expansion unit 71 expanding the BOG compressed by the multiple compressors 20*a*, 20*b*, 20*c*, 20*d* and having passed through the heat exchanger 30; a first intermediate cooler 41 cooling the BOG compressed by the multiple compressors 20*a*, 20*b*, 20*c*, 20*d* and having passed through the heat exchanger 30; a second expansion unit 72 expanding the BOG having passed through the first intermediate cooler 41; a second intermediate cooler 42 cooling the BOG having passed through the first intermediate cooler 41; a third expansion unit 73 expanding the BOG having passed through the second intermediate cooler 42; and a gas/liquid separator 60 separating the BOG, which has been partially reliquefied while passing through the third expansion unit 73, into reliquefied BOG and gaseous BOG.

According to this embodiment, the storage tank 10 stores liquefied gas, such as ethane, ethylene, and the like, and discharges BOG, which is generated through vaporization of the liquefied gas by heat transferred from the outside, when the inner pressure of the storage tank 10 exceeds a predetermined pressure. Although liquefied gas is illustrated by way of example as being discharged from the storage tank 10 in this embodiment, the liquefied gas may be discharged from a fuel tank adapted to store liquefied gas in order to supply the liquefied gas as fuel to an engine.

According to this embodiment, the multiple compressors 20*a*, 20*b*, 20*c*, 20*d* compress the BOG discharged from the storage tank 10 through multiple stages. According to this embodiment, the multistage compressor includes four compressors such that the BOG can be subjected to four stages of compression, but is not limited thereto.

When the multistage compressor is a four-stage compressor including four compressors as in this embodiment, the multistage compressor 20 includes a first compressor 20*a*, a second compressor 20*b*, a third compressor 20*c*, and a fourth compressor 20*d*, which are arranged in series to sequentially compress BOG. The BOG downstream of the first compressor 20*a* may have a pressure of 2 bar to 5 bar, for example, 3.5 bar, and the BOG downstream of the second compressor 20*b* may have a pressure of 10 bar to 15 bar, for example, 12 bar. In addition, the BOG downstream of the third compressor 20*c* may have a pressure of 25 bar to 35 bar, for example, 30.5 bar, and the BOG downstream of the fourth compressor 20*d* may have a pressure of 75 bar to 90 bar, for example, 83.5 bar.

The BOG reliquefaction apparatus may include multiple coolers 21*a*, 21*b*, 21*c*, 21*d* disposed downstream of the compressors 20*a*, 20*b*, 20*c*, 20*d*, respectively, to decrease the temperature of the BOG, which is increased not only in pressure but also in temperature after passing through each of the compressors 20*a*, 20*b*, 20*c*, 20*d*.

According to this embodiment, the heat exchanger 30 cools the BOG (hereinafter referred to as "Flow a") compressed by the multiple compressors 20*a*, 20*b*, 20*c*, 20*d* through heat exchange between the BOG (Flow a) and the BOG discharged from the storage tank 10. That is, the BOG compressed to a higher pressure by the multiple compressors 20*a*, 20*b*, 20*c*, 20*d* is decreased in temperature by the heat exchanger 30 using the BOG discharged from the storage tank 10 as a refrigerant.

According to this embodiment, the first expansion unit 71 is disposed on a line branched off from a line through which the BOG is supplied from the heat exchanger 30 to the first intermediate cooler 41, and expands some BOG (hereinafter referred to as "Flow a1") branched off from the BOG compressed by the multiple compressors 20*a*, 20*b*, 20*c*, 20*d* and having passed through the heat exchanger 30. The first expansion unit 71 may be an expansion valve or an expander.

Some BOG (Flow a1) branched off from the BOG compressed by the multiple compressors 20*a*, 20*b*, 20*c*, 20*d* and having passed through the heat exchanger 30 is expanded to a lower temperature and pressure by the first expansion unit 71. The BOG having passed through the first expansion unit 71 is supplied to the first intermediate cooler 41 to be used as a refrigerant for decreasing the temperature of the other BOG (hereinafter referred to as "Flow a2") compressed by the multiple compressors 20*a*, 20*b*, 20*c*, 20*d* and having passed through the heat exchanger 30.

According to this embodiment, the first intermediate cooler 41 decreases the temperature of the BOG (Flow a2), which has passed through the multiple compressors 20*a*, 20*b*, 20*c*, 20*d* and the heat exchanger 30, through heat exchange between some of the BOG (Flow a2) compressed by the multiple compressors 20*a*, 20*b*, 20*c*, 20*d* and having passed through the heat exchanger 30 and the BOG (Flow a1) expanded by the first expansion unit 71.

The BOG (Flow a2) cooled by the first intermediate cooler 41 after passing through the multiple compressors 20*a*, 20*b*, 20*c*, 20*d* and the heat exchanger 30 is sent to the second expansion unit 72 and the second intermediate cooler 42, and the BOG (Flow a1) sent to the first intermediate cooler 41 through the first expansion unit 71 is sent downstream of one compressor 20*b* of the multiple compressors 20*a*, 20*b*, 20*c*, 20*d*.

According to this embodiment, the second expansion unit 72 is disposed on a line branched off from a line through which the BOG is supplied from the first intermediate cooler 41 to the second intermediate cooler 42, and expands some of the BOG (Flow a21) cooled while passing through the heat exchanger 30 and the first intermediate cooler 41. The second expansion unit 72 may be an expansion valve or an expander.

Among the BOG (Flow a2) cooled while passing through the heat exchanger 30 and the first intermediate cooler 41, some BOG (Flow a21) is expanded to a lower temperature and pressure by the second expansion unit 72. The BOG (Flow a21) having passed through the second expansion unit 72 is supplied to the second intermediate cooler 42 to be used as a refrigerant for decreasing the temperature of the other BOG (Flow a22) cooled while passing through the heat exchanger 30 and the first intermediate cooler 41.

According to this embodiment, the second intermediate cooler 42 further decreases the temperature of the BOG (Flow a22), which is cooled while passing through the heat exchanger 30 and the first intermediate cooler 41, through heat exchange with the BOG (Flow a21) expanded by the second expansion unit 72.

The BOG cooled by the heat exchanger 30, the first intermediate cooler 41 and the second intermediate cooler 42 is sent to the gas/liquid separator 60 through the third expansion unit 73, and the BOG sent to the second intermediate cooler 42 through the second expansion unit 72 is sent downstream of one of the multiple compressors 20*a*, 20*b*, 20*c*, 20*d*.

The first intermediate cooler 41 decreases the temperature of the BOG primarily cooled by the heat exchanger 30 using the BOG discharged from the storage tank 10, whereas the second intermediate cooler 42 decreases the temperature of the BOG primarily cooled by the heat exchanger 30 and then secondarily cooled by the first intermediate cooler 41. Thus, the BOG (Flow a21) supplied as a refrigerant to the second intermediate cooler 42 is required to have a lower temperature than the BOG (Flow a1) supplied as a refrigerant to the first intermediate cooler 41. That is, the BOG having passed through the second expansion unit 72 is expanded more than the BOG having passed through the first expansion unit 71 and thus has a lower pressure than the BOG having passed through the first expansion unit 71. Accordingly, the BOG discharged from the first intermediate cooler 41 is sent to a compressor disposed farther downstream than a compressor to which the BOG discharged from the second intermediate cooler 42 is sent. The BOG discharged from the first and second intermediate coolers 41, 42 is merged with BOG having a similar pressure thereto among BOG subjected to multiple stages of compression through the multiple compressors 20*a*, 20*b*, 20*c*, 20*d*, and is then compressed.

On the other hand, since the BOG expanded by the first expansion unit 71 and the second expansion unit 72 is respectively used as a refrigerant for cooling the BOG in the first intermediate cooler 41 and the second intermediate cooler 42, the amounts of the BOG to be sent to the first expansion unit 71 and the second expansion unit 72 may be adjusted depending upon the degree of cooling the BOG in the first intermediate cooler 41 and the second intermediate cooler 42. Here, the BOG compressed by the multiple compressors 20*a*, 20*b*, 20*c*, 20*d* and having passed through the heat exchanger 30 is divided into two flows to be sent to the first expansion unit 71 and the first intermediate cooler 41, respectively. Thus, the ratio of BOG to be sent to the first expansion unit 71 is increased in order to cool the BOG to a lower temperature in the first intermediate cooler 41 and is decreased in order to cool a smaller amount of BOG in the first intermediate cooler 41.

Like the BOG sent from the heat exchanger 30 to the first intermediate cooler 41, when the BOG is sent from the first intermediate cooler 41 to the second intermediate cooler 42, the ratio of BOG to be sent to the second expansion unit 72 is increased in order to cool the BOG to a lower temperature in the second intermediate cooler 42 and the ratio of BOG to be sent to the first expansion unit 71 is decreased in order to cool a smaller amount of BOG in the second intermediate cooler 42.

In this embodiment, the reliquefaction apparatus includes two intermediate coolers 41, 42 and two expansion units 71, 72 disposed upstream of the intermediate coolers 41, 42, respectively. However, it should be noted that the number of intermediate coolers and the number of expansion units disposed upstream of the intermediate coolers can be changed, as needed. In addition, the intermediate coolers 41, 42 according to this embodiment may be intermediate coolers for vessels, as shown in FIG. 1, or may be typical heat exchangers.

According to this embodiment, the third expansion unit 73 expands the BOG having passed through the first intermediate cooler 41 and the second intermediate cooler 42 to about normal pressure.

According to this embodiment, the gas/liquid separator 60 separates the BOG, which has been partially reliquefied while passing through the third expansion unit 73, into reliquefied BOG and gaseous BOG. The gaseous BOG separated by the gas/liquid separator 60 is sent upstream of the heat exchanger 30 to be subjected to reliquefaction together with the BOG discharged from the storage tank 10, and the reliquefied BOG separated by the gas/liquid separator 60 is returned to the storage tank 10. In an embodiment wherein BOG is discharged from a fuel tank, the reliquefied BOG is sent to the fuel tank.

Hereinafter, the flow of BOG in the BOG reliquefaction apparatus according to this embodiment will be described with reference to FIG. 3.

BOG discharged from the storage tank 10 passes through the heat exchanger 30 and is then compressed by the multiple compressors 20*a*, 20*b*, 20*c*, 20*d*. The BOG compressed by the multiple compressors 20*a*, 20*b*, 20*c*, 20*d* has a pressure of about 40 bar to 100 bar, preferably about 80 bar. The BOG compressed by the multiple compressors 20*a*, 20*b*, 20*c*, 20*d* has a supercritical fluid phase in which liquid and gas are not distinguished from each other.

The BOG having passed through the multiple compressors 20*a*, 20*b*, 20*c*, 20*d* is kept in a supercritical fluid phase with a substantially similar pressure before the third expansion unit 73 while passing through the heat exchanger 30, the first intermediate cooler 41 and the second intermediate cooler 42. Since the BOG having passed through the multiple compressors 20*a*, 20*b*, 20*c*, 20*d* can undergo sequential decrease in temperature while passing through the heat exchanger 30, the first intermediate cooler 41 and the second intermediate cooler 42, and can undergo sequential decrease in pressure depending upon an application method of processes while passing through the heat exchanger 30, the first intermediate cooler 41 and the second intermediate cooler 42, the BOG may be in a gas/liquid mixed phase or in a liquid phase before the third expansion unit 73 while passing through the heat exchanger 30, the first intermediate cooler 41 and the second intermediate cooler 42.

The BOG having passed through the multiple compressors 20*a*, 20*b*, 20*c*, 20*d* is sent again to the heat exchanger 30 to be subjected to heat exchange with the BOG discharged from the storage tank 10. The BOG having passed through the multiple compressors 20*a*, 20*b*, 20*c*, 20*d* and the heat exchanger 30 may have a temperature of −10° C. to 35° C.

Among the BOG (Flow a) having passed through the multiple compressors 20*a*, 20*b*, 20*c*, 20*d* and the heat exchanger 30, some BOG (Flow a1) is sent to the first expansion unit 71 and the other BOG (Flow a2) is sent to the first intermediate cooler 41. The BOG (Flow a1) sent to the first expansion unit 71 is expanded to a lower temperature and pressure and is then sent to the first intermediate cooler 41, and the other BOG (Flow a2) sent to the first intermediate cooler 41 through the heat exchanger 30 is decreased in temperature through heat exchange with the BOG having passed through the first expansion unit 71.

The BOG (Flow a1) branched off from the BOG having passed through the heat exchanger 30 and sent to the first expansion unit 71 is expanded to a gas/liquid mixed phase by the first expansion unit 71. The BOG expanded to the gas/liquid mixed phase by the first expansion unit 71 is converted into a gas phase through heat exchange in the first intermediate cooler 41.

Among the BOG (Flow a2) sent to the first intermediate cooler 41 and subjected to heat exchange with the BOG having passed through the first expansion unit 71, some BOG (Flow a21) is sent to the second expansion unit 72 and the other BOG (Flow a22) is sent to the second intermediate cooler 42. The BOG (Flow a21) sent to the second expansion unit 72 is expanded to a lower temperature and pressure and is then sent to the second intermediate cooler 42, and the BOG sent to the second intermediate cooler 42 through the first intermediate cooler 41 is subjected to heat exchange with the BOG having passed through the second expansion unit 72 to have a lower temperature.

Like the BOG (Flow a1) partially branched off and sent to the first expansion unit 71 through the heat exchanger 30, the BOG (Flow a21) partially branched off and sent to the second expansion unit 72 through the first intermediate cooler 41 may be expanded to a gas/liquid mixed phase by the second expansion unit 72. The BOG expanded to the gas/liquid mixed phase by the second expansion unit 72 is converted into a gas phase through heat exchange in the second intermediate cooler 42.

The BOG (Flow a22) subjected to heat exchange with the BOG having passed through the second expansion unit 72 in the second intermediate cooler 42 is partially reliquefied through expansion to about normal pressure and a lower temperature by the third expansion unit 73. The BOG having passed through the third expansion unit 73 is sent to the gas/liquid separator 60, in which the BOG is separated into reliquefied BOG and gaseous BOG. The reliquefied BOG is supplied to the storage tank 10 and the gaseous BOG is sent upstream of the heat exchanger 30.

The BOG reliquefaction apparatus according to this embodiment cools the BOG through self-heat exchange using the BOG (Flow a1) expanded by the first expansion unit 71 and the BOG (Flow a21) expanded by the second expansion unit 72 as a refrigerant, thereby enabling reliquefaction of the BOG without a separate cold heat supply cycle.

In addition, a typical reliquefaction apparatus having a separate cold heat supply cycle consumes a power of about 2.4 kW to recover a heat quantity of 1 kW, whereas the BOG reliquefaction apparatus according to the embodiments consumes a power of about 1.7 kW to recover a heat quantity of 1 kW, thereby reducing energy consumption for operation of the reliquefaction apparatus.

Figure 4:
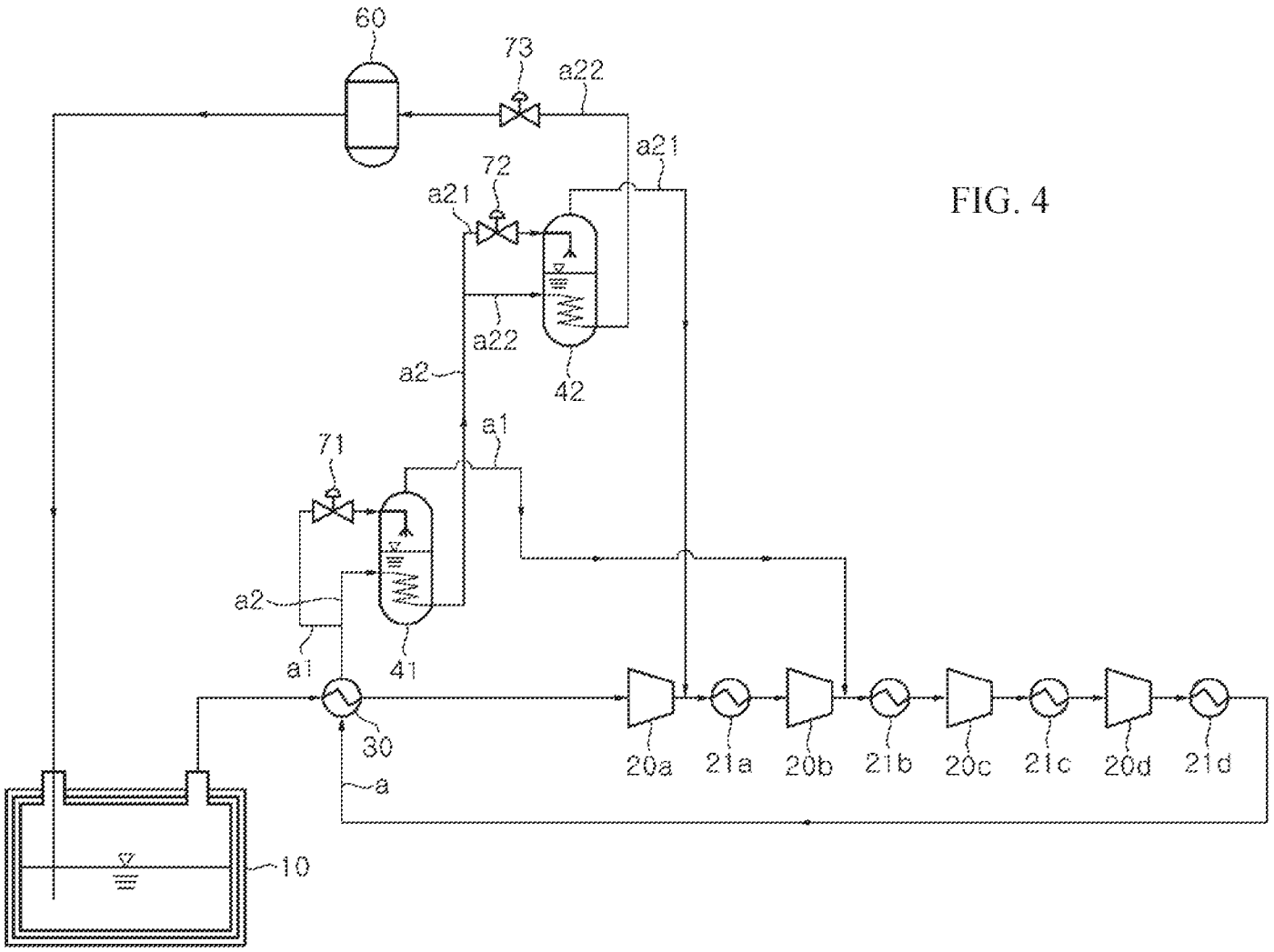
FIG. 4 is a schematic diagram of a BOG reliquefaction apparatus for vessels according to a third embodiment of the present invention.

FIG. 4 is a schematic diagram of a BOG reliquefaction apparatus for vessels according to a third embodiment of the present invention.

The BOG reliquefaction apparatus according to the third embodiment shown in FIG. 4 is distinguished from the BOG reliquefaction apparatus according to the second embodiment shown in FIG. 3 in that reliquefied BOG separated by the gas/liquid separator is sent together with gaseous BOG to the storage tank, and the following description will focus on the different features of the third embodiment. Detailed description of the same components as those of the BOG reliquefaction apparatus according to the second embodiment will be omitted herein.

Referring to FIG. 4, as in the third embodiment, the BOG reliquefaction apparatus according to this embodiment includes: multiple compressors 20*a*, 20*b*, 20*c*, 20*d*; a heat exchanger 30; a first expansion unit 71; a first intermediate cooler 41; a second expansion unit 72; a second intermediate cooler 42; a third expansion unit 73; and a gas/liquid separator 60.

As in the second embodiment, the storage tank 10 according to this embodiment stores liquefied gas, such as ethane, ethylene, and the like, and discharges BOG, which is generated through natural vaporization of the liquefied gas by heat transferred from the outside, when the inner pressure of the storage tank 10 exceeds a predetermined pressure.

As in the second embodiment, the multiple compressors 20*a*, 20*b*, 20*c*, 20*d* according to this embodiment compresses BOG discharged from the storage tank 10 through multiple stages. Multiple coolers 21*a*, 21*b*, 21*c*, 21*d* may be disposed downstream of the multiple compressors 20*a*, 20*b*, 20*c*, 20*d*, respectively.

As in the second embodiment, the heat exchanger 30 according to this embodiment performs heat exchange between the BOG compressed by the multiple compressors 20*a*, 20*b*, 20*c*, 20*d* and the BOG discharged from the storage tank 10.

As in the second embodiment, the first expansion unit 71 according to this embodiment is disposed on a line branched off from a line through which the BOG is supplied from the heat exchanger 30 to the first intermediate cooler 41, and expands some of the BOG compressed by the multiple compressors 20*a*, 20*b*, 20*c*, 20*d* and having passed through the heat exchanger 30.

As in the second embodiment, the first intermediate cooler 41 according to this embodiment decreases the temperature of the BOG having passed through the multiple compressors 20*a*, 20*b*, 20*c*, 20*d* and the heat exchanger 30 through heat exchange between some of the BOG compressed by the multiple compressors 20*a*, 20*b*, 20*c*, 20*d* and having passed through the heat exchanger 30 and the BOG expanded by the first expansion unit 71.

As in the second embodiment, the second expansion unit 72 according to this embodiment is disposed on a line branched off from a line through which the BOG is supplied from the first intermediate cooler 41 to the second intermediate cooler 42, and expands some of the BOG cooled while passing through the heat exchanger 30 and the first intermediate cooler 41.

As in the second embodiment, the second intermediate cooler 42 according to this embodiment further decreases the temperature of the BOG, which is cooled while passing through the heat exchanger 30 and the first intermediate cooler 41, through heat exchange between the BOG cooled while passing through the heat exchanger 30 and the first intermediate cooler 41 and the BOG expanded by the second expansion unit 72.

As in the second embodiment, the BOG discharged from the first intermediate cooler 41 is sent downstream of a compressor disposed farther downstream than a compressor with which the BOG discharged from the second intermediate cooler 42 is merged.

In addition, as in the second embodiment, the ratio of BOG to be sent to the first expansion unit 71 is increased in order to cool the BOG to a lower temperature in the first intermediate cooler 41 and is decreased in order to cool a smaller amount of BOG in the first intermediate cooler 41.

Like the BOG sent from the heat exchanger 30 to the first intermediate cooler 41, when the BOG is sent from the first intermediate cooler 41 to the second intermediate cooler 42, the ratio of BOG to be sent to the second expansion unit 72 is increased in order to cool the BOG to a lower temperature in the second intermediate cooler 42 and the ratio of BOG to be sent to the first expansion unit 71 is decreased in order to cool a smaller amount of BOG in the second intermediate cooler 42.

As in the second embodiment, the third expansion unit 73 according to this embodiment expands the BOG having passed through the first intermediate cooler 41 and the second intermediate cooler 42 to about normal pressure.

As in the second embodiment, the gas/liquid separator 60 according to this embodiment separates the BOG, which has been partially reliquefied while passing through the third expansion unit 73, into reliquefied BOG and gaseous BOG.

However, unlike the second embodiment, the gaseous BOG separated by the gas/liquid separator 60 according to this embodiment is sent together with the reliquefied BOG to the storage tank 10. The gaseous BOG sent to the storage tank 10 is sent together with the BOG discharged from the storage tank 10 to the heat exchanger 30 and is subjected to the reliquefaction process.

Hereinafter, the flow of BOG in the BOG reliquefaction apparatus according to this embodiment will be described with reference to FIG. 4.

As in the second embodiment, the BOG discharged from the storage tank 10 passes through the heat exchanger 30 and is then compressed by the multiple compressors 20*a*, 20*b*, 20*c*, 20*d*.

As in the second embodiment, the BOG having passed through the multiple compressors 20*a*, 20*b*, 20*c*, 20*d* is sent again to the heat exchanger 30 to be subjected to heat exchange with the BOG discharged from the storage tank 10. Among the BOG having passed through the multiple compressors 20*a*, 20*b*, 20*c*, 20*d* and the heat exchanger 30, some BOG is sent to the first expansion unit 71 and the other BOG is sent to the first intermediate cooler 41. The BOG sent to the first expansion unit 71 is expanded to a lower temperature and pressure and is then sent to the first intermediate cooler 41, and the other BOG sent to the first intermediate cooler 41 through the heat exchanger 30 is decreased in temperature through heat exchange with the BOG having passed through the first expansion unit 71.

As in the second embodiment, among the BOG sent to the first intermediate cooler 41 and subjected to heat exchange with the BOG having passed through the first expansion unit 71, some BOG is sent to the second expansion unit 72 and the other BOG is sent to the second intermediate cooler 42. The BOG sent to the second expansion unit 72 is expanded to a lower temperature and pressure and is then sent to the second intermediate cooler 42, and the BOG sent to the second intermediate cooler 42 through the first intermediate cooler 41 is subjected to heat exchange with the BOG having passed through the second expansion unit 72 to have a lower temperature.

As in the second embodiment, the BOG subjected to heat exchange with the BOG having passed through the second expansion unit 72 in the second intermediate cooler 42 is partially reliquefied through expansion to about normal pressure and a lower temperature by the third expansion unit 73. The BOG having passed through the third expansion unit 73 is sent to the gas/liquid separator 60, in which the BOG is separated into reliquefied BOG and gaseous BOG.

However, unlike the second embodiment, both the gaseous BOG and the reliquefied BOG separated by the gas/liquid separator 60 according to this embodiment are sent to the storage tank 10.

Figure 5:
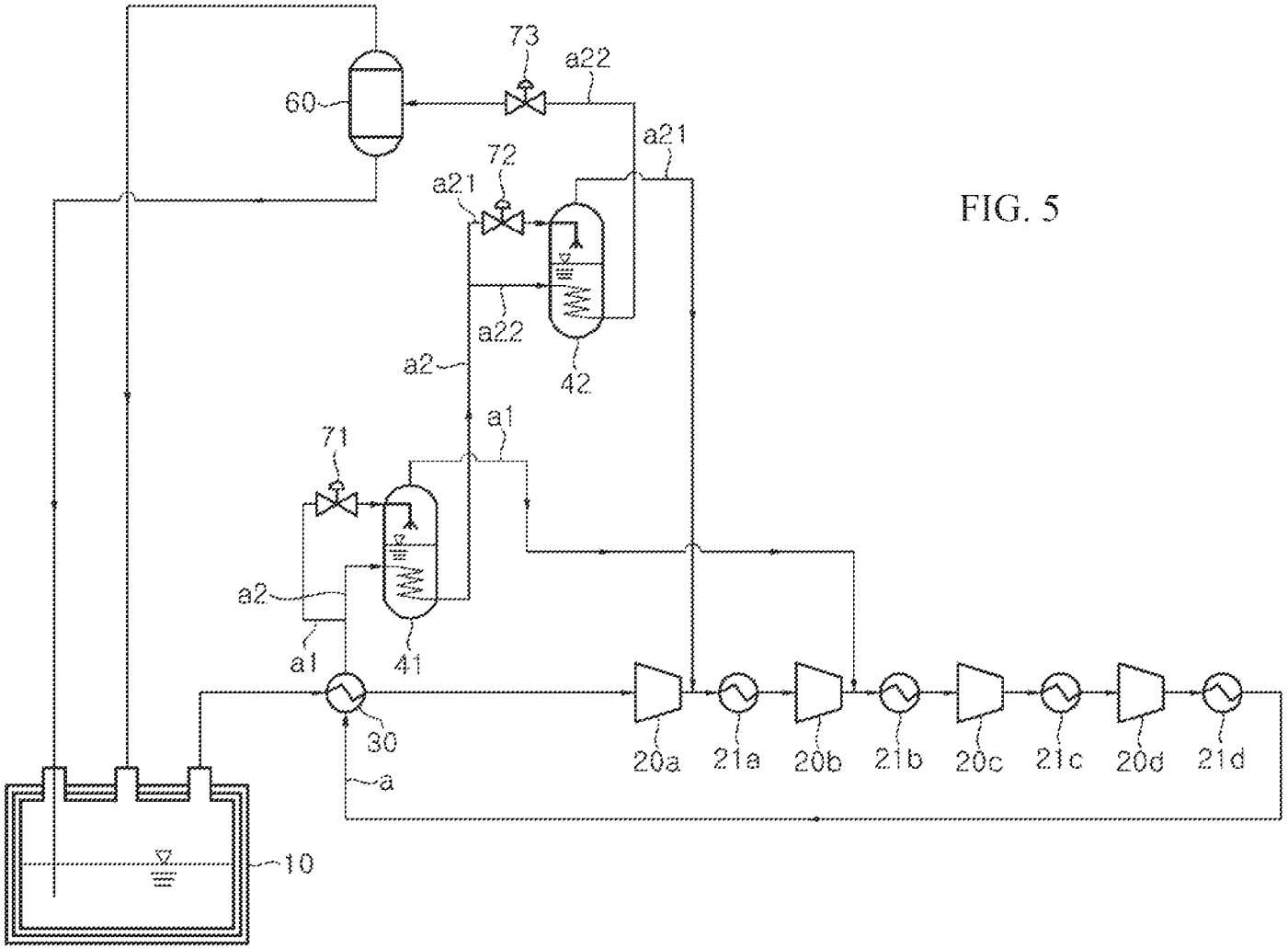
FIG. 5 is a schematic diagram of a BOG reliquefaction apparatus for vessels according to a fourth embodiment of the present invention.

FIG. 5 is a schematic diagram of a BOG reliquefaction apparatus for vessels according to a fourth embodiment of the present invention.

The BOG reliquefaction apparatus according to the fourth embodiment shown in FIG. 5 is distinguished from the BOG reliquefaction apparatus according to the second embodiment shown in FIG. 3 in that gaseous BOG is supplied to the storage tank, and is distinguished from the BOG reliquefaction apparatus according to the third embodiment shown in FIG. 4 in that the gaseous BOG is separated from reliquefied BOG and separately sent to the storage tank. The following description will focus on the different features of the fourth embodiment. Detailed description of the same components as those of the BOG reliquefaction apparatus according to the second and third embodiments will be omitted.

Referring to FIG. 5, as in the second and third embodiments, the BOG reliquefaction apparatus according to this embodiment includes: multiple compressors 20*a*, 20*b*, 20*c*, 20*d*; a heat exchanger 30; a first expansion unit 71; a first intermediate cooler 41; a second expansion unit 72; a second intermediate cooler 42; a third expansion unit 73; and a gas/liquid separator 60.

As in the second and third embodiments, the storage tank 10 according to this embodiment stores liquefied gas, such as ethane, ethylene, and the like, and discharges BOG, which is generated through vaporization of the liquefied gas by heat transferred from the outside, when the inner pressure of the storage tank 10 exceeds a predetermined pressure.

As in the second and third embodiments, the multiple compressors 20*a*, 20*b*, 20*c*, 20*d* according to this embodiment compresses BOG discharged from the storage tank 10 through multiple stages. Multiple coolers 21*a*, 21*b*, 21*c*, 21*d* may be disposed downstream of the multiple compressors 20*a*, 20*b*, 20*c*, 20*d*, respectively.

As in the second and third embodiments, the heat exchanger 30 according to this embodiment performs heat exchange between the BOG compressed by the multiple compressors 20*a*, 20*b*, 20*c*, 20*d* and the BOG discharged from the storage tank 10.

As in the second and third embodiments, the first expansion unit 71 according to this embodiment is disposed on a line branched off from a line through which the BOG is supplied from the heat exchanger 30 to the first intermediate cooler 41, and expands some of the BOG compressed by the multiple compressors 20*a*, 20*b*, 20*c*, 20*d* and having passed through the heat exchanger 30.

As in the second and third embodiments, the first intermediate cooler 41 according to this embodiment decreases the temperature of the BOG having passed through the multiple compressors 20*a*, 20*b*, 20*c*, 20*d* and the heat exchanger 30 through heat exchange between some of the BOG compressed by the multiple compressors 20*a*, 20*b*, 20*c*, 20*d* and having passed through the heat exchanger 30 and the BOG expanded by the first expansion unit 71.

As in the second and third embodiments, the second expansion unit 72 according to this embodiment is disposed on a line branched off from a line through which the BOG is supplied from the first intermediate cooler 41 to the second intermediate cooler 42, and expands some of the BOG cooled while passing through the heat exchanger 30 and the first intermediate cooler 41.

As in the second and third embodiments, the second intermediate cooler 42 according to this embodiment further decreases the temperature of the BOG, which is cooled while passing through the heat exchanger 30 and the first intermediate cooler 41, through heat exchange between the BOG cooled while passing through the heat exchanger 30 and the first intermediate cooler 41 and the BOG expanded by the second expansion unit 72.

As in the second and third embodiments, the BOG discharged from the first intermediate cooler 41 is sent downstream of a compressor disposed farther downstream than a compressor with which the BOG discharged from the second intermediate cooler 42 is merged.

In addition, as in the second and third embodiments, the ratio of BOG to be sent to the first expansion unit 71 is increased in order to cool the BOG to a lower temperature in the first intermediate cooler 41 and is decreased in order to cool a smaller amount of BOG in the first intermediate cooler 41.

Like the BOG sent from the heat exchanger 30 to the first intermediate cooler 41, when the BOG is sent from the first intermediate cooler 41 to the second intermediate cooler 42, the ratio of BOG to be sent to the second expansion unit 72 is increased in order to cool the BOG to a lower temperature in the second intermediate cooler 42 and the ratio of BOG to be sent to the first expansion unit 71 is decreased in order to cool a smaller amount of BOG in the second intermediate cooler 42.

As in the second and third embodiments, the third expansion unit 73 according to this embodiment expands the BOG having passed through the first intermediate cooler 41 and the second intermediate cooler 42 to about normal pressure.

As in the second and third embodiments, the gas/liquid separator 60 according to this embodiment separates the BOG, which has been partially reliquefied while passing through the third expansion unit 73, into reliquefied BOG and gaseous BOG.

However, unlike the second embodiment, the gaseous BOG separated by the gas/liquid separator 60 according to this embodiment is sent to the storage tank 10. In addition, unlike the third embodiment, the gaseous BOG separated by the gas/liquid separator 60 according to this embodiment is divided from the reliquefied BOG and is separately sent to the storage tank 10 instead of being sent together with the reliquefied BOG thereto.

Hereinafter, the flow of BOG in the BOG reliquefaction apparatus according to this embodiment will be described with reference to FIG. 5.

As in the second and third embodiments, the BOG discharged from the storage tank 10 is compressed by the multiple compressors 20*a*, 20*b*, 20*c*, 20*d* after passing through the heat exchanger 30.

As in the second and third embodiments, the BOG having passed through the multiple compressors 20*a*, 20*b*, 20*c*, 20*d* is sent again to the heat exchanger 30 to be subjected to heat exchange with the BOG discharged from the storage tank 10. Among the BOG having passed through the multiple compressors 20*a*, 20*b*, 20*c*, 20*d* and the heat exchanger 30, some BOG is sent to the first expansion unit 71 and the other BOG is sent to the first intermediate cooler 41. The BOG sent to the first expansion unit 71 is expanded to a lower temperature and pressure and is then sent to the first intermediate cooler 41, and the other BOG sent to the first intermediate cooler 41 through the heat exchanger 30 is decreased in temperature through heat exchange with the BOG having passed through the first expansion unit 71.

As in the second and third embodiments, among the BOG sent to the first intermediate cooler 41 and subjected to heat exchange with the BOG having passed through the first expansion unit 71, some BOG is sent to the second expansion unit 72 and the other BOG is sent to the second intermediate cooler 42. The BOG sent to the second expansion unit 72 is expanded to a lower temperature and pressure and is then sent to the second intermediate cooler 42, and the BOG sent to the second intermediate cooler 42 through the first intermediate cooler 41 is subjected to heat exchange with the BOG having passed through the second expansion unit 72 to have a lower temperature.

As in the second and third embodiments, the BOG subjected to heat exchange with the BOG having passed through the second expansion unit 72 in the second intermediate cooler 42 is partially reliquefied through expansion to about normal pressure and a lower temperature by the third expansion unit 73. The BOG having passed through the third expansion unit 73 is sent to the gas/liquid separator 60, in which the BOG is separated into reliquefied BOG and gaseous BOG.

However, unlike the second embodiment, the gaseous BOG separated by the gas/liquid separator 60 is supplied to the storage tank 10. In addition, unlike the third embodiment, the gaseous BOG separated by the gas/liquid separator 60 is divided from the reliquefied BOG and is separately supplied to the storage tank 10 instead of being sent together with the reliquefied BOG thereto.

Figure 6:
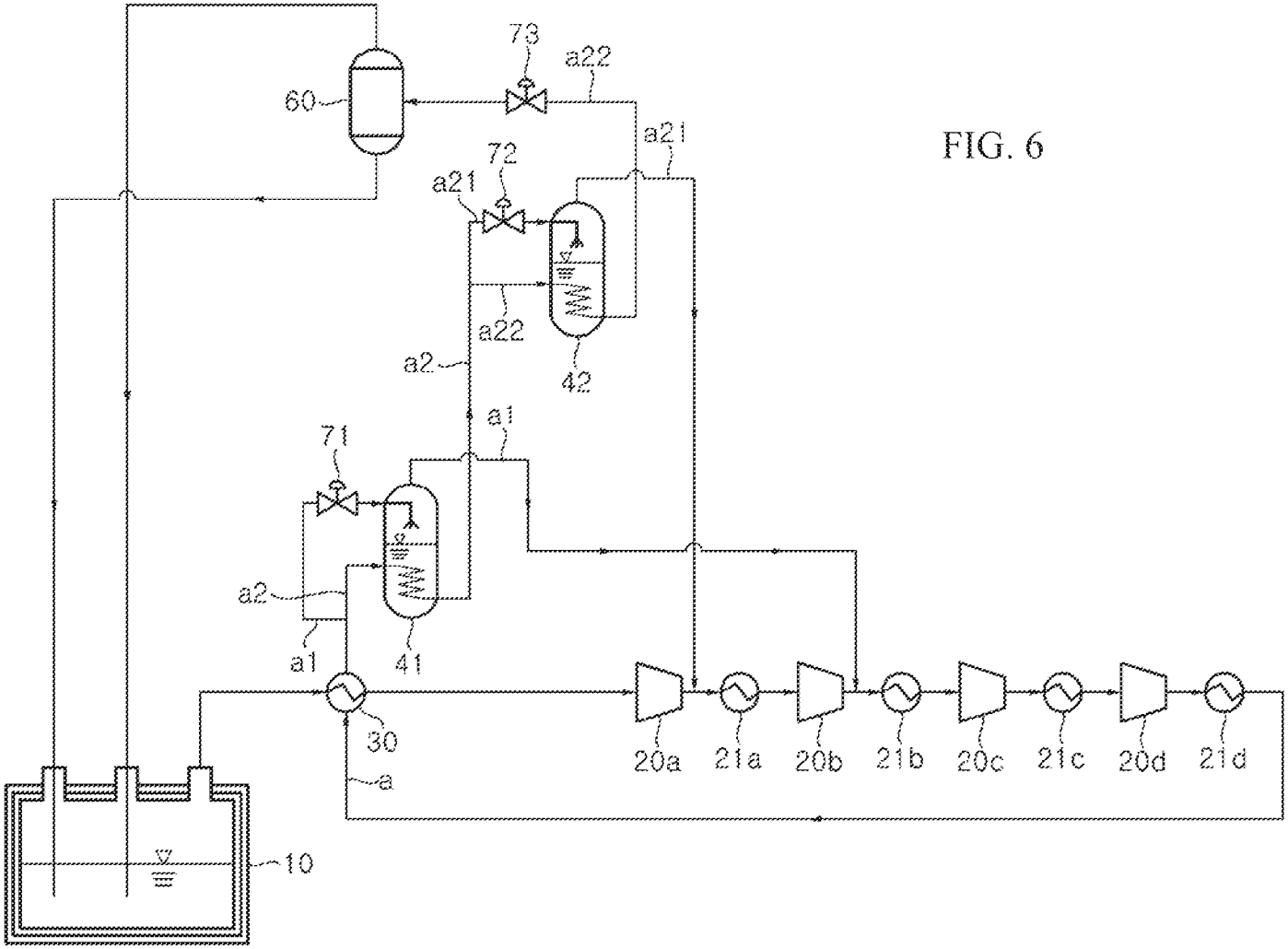
FIG. 6 is a schematic diagram of a BOG reliquefaction apparatus for vessels according to a fifth embodiment of the present invention.

FIG. 6 is a schematic diagram of a BOG reliquefaction apparatus for vessels according to a fifth embodiment of the present invention.

The BOG reliquefaction apparatus according to the fifth embodiment shown in FIG. 6 is distinguished from the BOG reliquefaction apparatus according to the second embodiment shown in FIG. 3 in that gaseous BOG is supplied to the storage tank, and is distinguished from the BOG reliquefaction apparatus according to the fourth embodiment shown in FIG. 5 in that the gaseous BOG is sent to a lower portion of the storage tank. The following description will focus on the different features of the fifth embodiment. Detailed description of the same components as those of the BOG reliquefaction apparatus according to the second and fourth embodiments will be omitted.

Referring to FIG. 6, as in the second and fourth embodiments, the BOG reliquefaction apparatus according to the fifth embodiment includes: multiple compressors 20*a*, 20*b*, 20*c*, 20*d*; a heat exchanger 30; a first expansion unit 71; a first intermediate cooler 41; a second expansion unit 72; a second intermediate cooler 42; a third expansion unit 73; and a gas/liquid separator 60.

As in the second and fourth embodiments, the storage tank 10 according to this embodiment stores liquefied gas, such as ethane, ethylene, and the like, and discharges BOG, which is generated through vaporization of the liquefied gas by heat transferred from the outside, when the inner pressure of the storage tank 10 exceeds a predetermined pressure.

As in the second and fourth embodiments, the multiple compressors 20*a*, 20*b*, 20*c*, 20*d* compresses BOG discharged from the storage tank 10 through multiple stages. Multiple coolers 21*a*, 21*b*, 21*c*, 21*d* may be disposed downstream of the multiple compressors 20*a*, 20*b*, 20*c*, 20*d*, respectively.

As in the second and fourth embodiments, the heat exchanger 30 according to this embodiment performs heat exchange between the BOG compressed by the multiple compressors 20*a*, 20*b*, 20*c*, 20*d* and the BOG discharged from the storage tank 10.

As in the second and fourth embodiments, the first expansion unit 71 according to this embodiment is disposed on a line branched off from a line through which the BOG is supplied from the heat exchanger 30 to the first intermediate cooler 41, and expands some of the BOG compressed by the multiple compressors 20*a*, 20*b*, 20*c*, 20*d* and having passed through the heat exchanger 30.

As in the second and fourth embodiments, the first intermediate cooler 41 according to this embodiment decreases the temperature of the BOG having passed through the multiple compressors 20*a*, 20*b*, 20*c*, 20*d* and the heat exchanger 30 through heat exchange between some of the BOG compressed by the multiple compressors 20*a*, 20*b*, 20*c*, 20*d* and having passed through the heat exchanger 30 and the BOG expanded by the first expansion unit 71.

As in the second and fourth embodiments, the second expansion unit 72 according to this embodiment is disposed on a line branched off from a line through which the BOG is supplied from the first intermediate cooler 41 to the second intermediate cooler 42, and expands some of the BOG cooled while passing through the heat exchanger 30 and the first intermediate cooler 41.

As in the second and fourth embodiments, the second intermediate cooler 42 according to this embodiment further decreases the temperature of the BOG, which is cooled while passing through the heat exchanger 30 and the first intermediate cooler 41, through heat exchange between the BOG cooled while passing through the heat exchanger 30 and the first intermediate cooler 41 and the BOG expanded by the second expansion unit 72.

As in the second and fourth embodiments, the BOG discharged from the first intermediate cooler 41 is sent downstream of a compressor disposed farther downstream than a compressor with which the BOG discharged from the second intermediate cooler 42 is merged.

In addition, as in the second and fourth embodiments, the ratio of BOG to be sent to the first expansion unit 71 is increased in order to cool the BOG to a lower temperature in the first intermediate cooler 41 and is decreased in order to cool a smaller amount of BOG in the first intermediate cooler 41.

Like the BOG sent from the heat exchanger 30 to the first intermediate cooler 41, when the BOG is sent from the first intermediate cooler 41 to the second intermediate cooler 42, the ratio of BOG to be sent to the second expansion unit 72 is increased in order to cool the BOG to a lower temperature in the second intermediate cooler 42 and the ratio of BOG to be sent to the first expansion unit 71 is decreased in order to cool a smaller amount of BOG in the second intermediate cooler 42.

As in the second and fourth embodiments, the third expansion unit 73 according to this embodiment expands the BOG having passed through the first intermediate cooler 41 and the second intermediate cooler 42 to about normal pressure.

As in the second and fourth embodiments, the gas/liquid separator 60 according to this embodiment separates the BOG, which has been partially reliquefied while passing through the third expansion unit 73, into reliquefied BOG and gaseous BOG.

However, unlike the second embodiment, both the gaseous BOG and the reliquefied BOG separated by the gas/liquid separator 60 according to this embodiment are supplied to the storage tank 10. In addition, unlike the fourth embodiment, the gaseous BOG separated by the gas/liquid separator 60 according to this embodiment is sent to the lower portion of the storage tank 10, which is filled with liquefied natural gas, instead of being sent to an upper portion of the storage tank 10.

When the gaseous BOG separated by the gas/liquid separator 60 is sent to the lower portion of the storage tank 10, the gaseous BOG can be decreased in temperature or partially liquefied by the liquefied natural gas, thereby improving reliquefaction efficiency. Further, since the liquefied natural gas inside the storage tank 10 has a lower temperature at a lower level than at a higher level, it is desirable that the gaseous BOG be sent to the lowest portion of the storage tank 10.

Hereinafter, the flow of BOG in the BOG reliquefaction apparatus according to this embodiment will be described with reference to FIG. 6.

As in the second and fourth embodiments, the BOG discharged from the storage tank 10 is compressed by the multiple compressors 20*a*, 20*b*, 20*c*, 20*d* after passing through the heat exchanger 30.

As in the second and fourth embodiments, the BOG having passed through the multiple compressors 20*a*, 20*b*, 20*c*, 20*d* is sent again to the heat exchanger 30 to be subjected to heat exchange with the BOG discharged from the storage tank 10. Among the BOG having passed through the multiple compressors 20*a*, 20*b*, 20*c*, 20*d* and the heat exchanger 30, some BOG is sent to the first expansion unit 71 and the other BOG is sent to the first intermediate cooler 41. The BOG sent to the first expansion unit 71 is expanded to a lower temperature and pressure and is then sent to the first intermediate cooler 41, and the other BOG sent to the first intermediate cooler 41 through the heat exchanger 30 is decreased in temperature through heat exchange with the BOG having passed through the first expansion unit 71.

As in the second and fourth embodiments, among the BOG sent to the first intermediate cooler 41 and subjected to heat exchange with the BOG having passed through the first expansion unit 71, some BOG is sent to the second expansion unit 72 and the other BOG is sent to the second intermediate cooler 42. The BOG sent to the second expansion unit 72 is expanded to a lower temperature and pressure and is then sent to the second intermediate cooler 42, and the BOG sent to the second intermediate cooler 42 through the first intermediate cooler 41 is subjected to heat exchange with the BOG having passed through the second expansion unit 72 to have a lower temperature.

As in the second and fourth embodiments, the BOG subjected to heat exchange with the BOG having passed through the second expansion unit 72 in the second intermediate cooler 42 is partially reliquefied through expansion to about normal pressure and a lower temperature by the third expansion unit 73. The BOG having passed through the third expansion unit 73 is sent to the gas/liquid separator 60, in which the BOG is separated into reliquefied BOG and gaseous BOG.

However, unlike the second embodiment, both the gaseous BOG and the reliquefied BOG separated by the gas/liquid separator 60 according to this embodiment are sent to the storage tank 10. In addition, unlike the fourth embodiment, the gaseous BOG separated by the gas/liquid separator 60 according to this embodiment is sent to the lower portion of the storage tank 10, which is filled with liquefied natural gas, instead of being sent to an upper portion of the storage tank 10.

Figure 7:
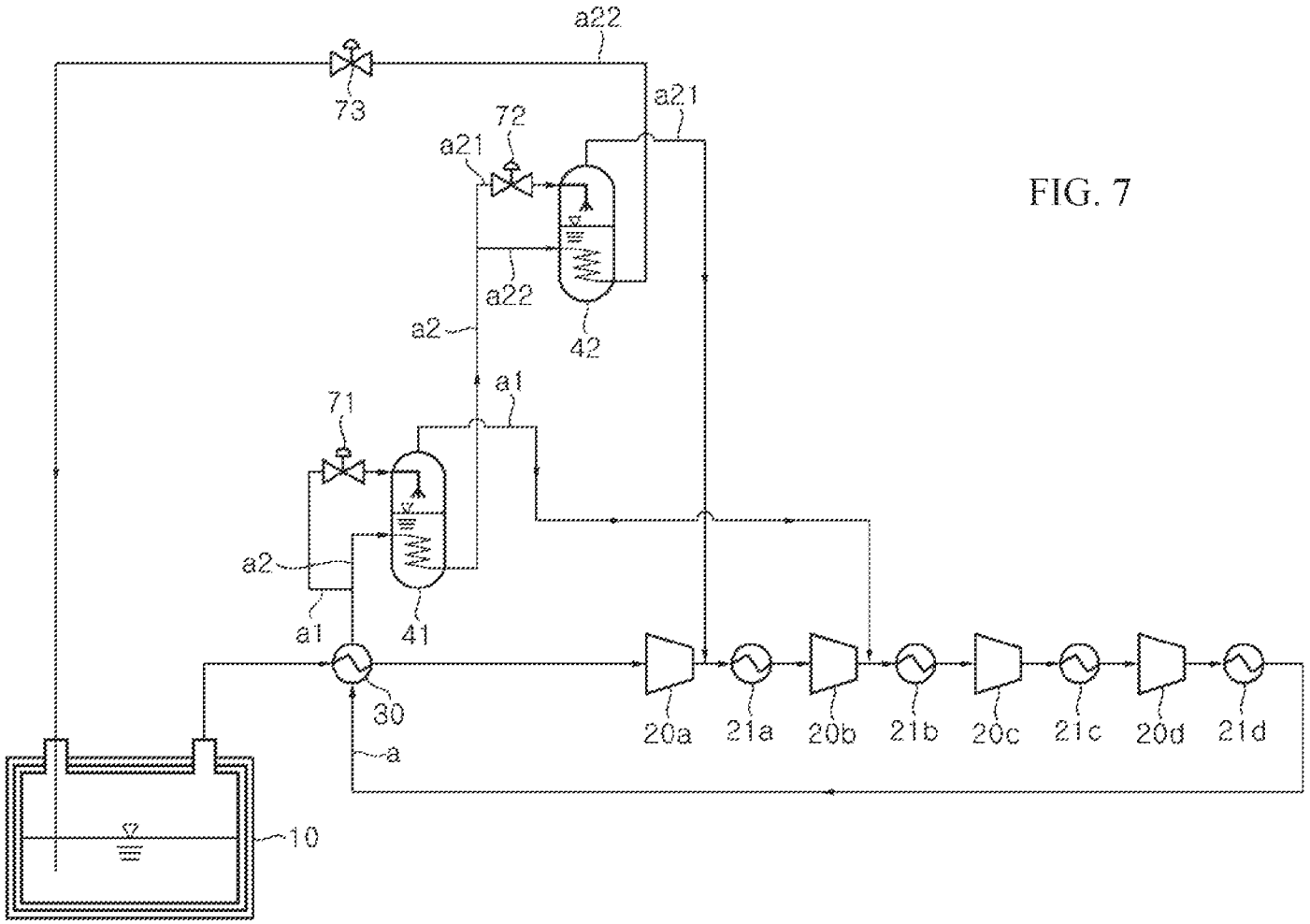
FIG. 7 is a schematic diagram of a BOG reliquefaction apparatus for vessels according to a seventh embodiment of the present invention.

FIG. 7 is a schematic diagram of a BOG reliquefaction apparatus for vessels according to a sixth embodiment of the present invention.

The BOG reliquefaction apparatus according to the sixth embodiment shown in FIG. 7 is distinguished from the BOG reliquefaction apparatus according to the second embodiment shown in FIG. 3 in that the BOG reliquefaction apparatus according to the sixth embodiment does not include the gas/liquid separator. The following description will focus on the different features of the sixth embodiment. Detailed description of the same components as those of the BOG reliquefaction apparatus according to the second embodiment will be omitted.

Referring to FIG. 7, as in the second embodiment, the BOG reliquefaction apparatus according to this embodiment includes: multiple compressors 20*a*, 20*b*, 20*c*, 20*d*; a heat exchanger 30; a first expansion unit 71; a first intermediate cooler 41; a second expansion unit 72; a second intermediate cooler 42; and a third expansion unit 73. Here, the BOG reliquefaction apparatus according to this embodiment does not include the gas/liquid separator 60.

As in the second embodiment, the storage tank 10 according to this embodiment stores liquefied gas, such as ethane, ethylene, and the like, and discharges BOG, which is generated through vaporization of the liquefied gas by heat transferred from the outside, when the inner pressure of the storage tank 10 exceeds a predetermined pressure.

As in the second embodiment, the multiple compressors 20*a*, 20*b*, 20*c*, 20*d* according to this embodiment compresses BOG discharged from the storage tank 10 through multiple stages. Multiple coolers 21*a*, 21*b*, 21*c*, 21*d* may be disposed downstream of the multiple compressors 20*a*, 20*b*, 20*c*, 20*d*, respectively.

As in the second embodiment, the heat exchanger 30 according to this embodiment performs heat exchange between the BOG compressed by the multiple compressors 20*a*, 20*b*, 20*c*, 20*d* and the BOG discharged from the storage tank 10.

As in the second embodiment, the first expansion unit 71 according to this embodiment is disposed on a line branched off from a line through which the BOG is supplied from the heat exchanger 30 to the first intermediate cooler 41, and expands some of the BOG compressed by the multiple compressors 20*a*, 20*b*, 20*c*, 20*d* and having passed through the heat exchanger 30.

As in the second embodiment, the first intermediate cooler 41 according to this embodiment decreases the temperature of the BOG having passed through the multiple compressors 20*a*, 20*b*, 20*c*, 20*d* and the heat exchanger 30 through heat exchange between some of the BOG compressed by the multiple compressors 20*a*, 20*b*, 20*c*, 20*d* and having passed through the heat exchanger 30 and the BOG expanded by the first expansion unit 71.

As in the second embodiment, the second expansion unit 72 according to this embodiment is disposed on a line branched off from a line through which the BOG is supplied from the first intermediate cooler 41 to the second intermediate cooler 42, and expands some of the BOG cooled while passing through the heat exchanger 30 and the first intermediate cooler 41.

As in the second embodiment, the second intermediate cooler 42 according to this embodiment further decreases the temperature of the BOG, which is cooled while passing through the heat exchanger 30 and the first intermediate cooler 41, through heat exchange between the BOG cooled while passing through the heat exchanger 30 and the first intermediate cooler 41 and the BOG expanded by the second expansion unit 72.

As in the second embodiment, the BOG discharged from the first intermediate cooler 41 is sent downstream of a compressor disposed farther downstream than a compressor with which the BOG discharged from the second intermediate cooler 42 is merged.

In addition, as in the second embodiment, the ratio of BOG to be sent to the first expansion unit 71 is increased in order to cool the BOG to a lower temperature in the first intermediate cooler 41 and is decreased in order to cool a smaller amount of BOG in the first intermediate cooler 41.

Like the BOG sent from the heat exchanger 30 to the first intermediate cooler 41, when the BOG is sent from the first intermediate cooler 41 to the second intermediate cooler 42, the ratio of BOG to be sent to the second expansion unit 72 is increased in order to cool the BOG to a lower temperature in the second intermediate cooler 42 and the ratio of BOG to be sent to the first expansion unit 71 is decreased in order to cool a smaller amount of BOG in the second intermediate cooler 42.

As in the second embodiment, the third expansion unit 73 according to this embodiment expands the BOG having passed through the first intermediate cooler 41 and the second intermediate cooler 42 to about normal pressure.

According to this embodiment, however, since the BOG reliquefaction apparatus does not include the gas/liquid separator 60, both the gaseous BOG and the reliquefied BOG having passed through the third expansion unit 73 are sent in a mixed phase to the storage tank 10.

As in the second to sixth embodiments described above, when gaseous BOG is sent to the storage tank instead of being sent upstream of the heat exchanger 30, advantageously, the BOG can be efficiently discharged from the storage tank 10 even without a separate pump, if the storage tank 10 is a compression tank.

Hereinafter, the flow of BOG in the BOG reliquefaction apparatus according to this embodiment will be described with reference to FIG. 7.

As in the second embodiment, the BOG discharged from the storage tank 10 passes through the heat exchanger 30 and is then compressed by the multiple compressors 20*a*, 20*b*, 20*c*, 20*d*.

As in the second embodiment, the BOG having passed through the multiple compressors 20*a*, 20*b*, 20*c*, 20*d* is sent again to the heat exchanger 30 to be subjected to heat exchange with the BOG discharged from the storage tank 10. Among the BOG having passed through the multiple compressors 20*a*, 20*b*, 20*c*, 20*d* and the heat exchanger 30, some BOG is sent to the first expansion unit 71 and the other BOG is sent to the first intermediate cooler 41. The BOG sent to the first expansion unit 71 is expanded to a lower temperature and pressure and is then sent to the first intermediate cooler 41, and the other BOG sent to the first intermediate cooler 41 through the heat exchanger 30 is decreased in temperature through heat exchange with the BOG having passed through the first expansion unit 71.

As in the second embodiment, among the BOG sent to the first intermediate cooler 41 and subjected to heat exchange with the BOG having passed through the first expansion unit 71, some BOG is sent to the second expansion unit 72 and the other BOG is sent to the second intermediate cooler 42. The BOG sent to the second expansion unit 72 is expanded to a lower temperature and pressure and is then sent to the second intermediate cooler 42, and the BOG sent to the second intermediate cooler 42 through the first intermediate cooler 41 is subjected to heat exchange with the BOG having passed through the second expansion unit 72 to have a lower temperature.

As in the second embodiment, the BOG subjected to heat exchange with the BOG having passed through the second expansion unit 72 in the second intermediate cooler 42 is partially reliquefied through expansion to about normal pressure and a lower temperature by the third expansion unit 73. Here, unlike the third embodiment, the BOG having passed through the third expansion unit 73 is sent in a gas/liquid phase to the storage tank 10.

It will be apparent to those skilled in the art that the present invention is not limited to the embodiments described above and that various modifications, changes, alterations, and equivalent embodiments can be made without departing from the spirit and scope of the present invention.

The invention claimed is:

1. An apparatus for reliquefaction of boil-off gas (BOG) generated in a liquefied gas storage tank provided to a vessel, the apparatus comprising:

a compressor configured to compress BOG discharged from the storage tank to provide compressed BOG;

a heat exchanger configured to cool the compressed BOG using additional BOG discharged from the storage tank, the compressed BOG from the heat exchanger being divided into at least two flows comprising a first flow and a second flow;

a first expansion unit configured to expand the first flow to provide an expanded first flow;

a first intermediate cooler configured to cool the second flow using the expanded first flow to provide a cooled second flow;

a receiver configured to receive the cooled second flow for holding BOG in the receiver;

a level control line configured to discharge BOG from the receiver for regulating a BOG level in the receiver and further configured to divide the BOG discharged from the receiver into at least two flows comprising a third flow and a fourth flow;

a second expansion unit configured to expand the third flow to provide an expanded third flow;

a second intermediate cooler configured to cool the fourth flow by heat-exchanging with the expanded third flow to provide a cooled fourth flow and a heat-exchanged, expanded third flow; and a third expansion unit configured to expand the cooled fourth flow to provide an expanded, cooled fourth flow, wherein the apparatus is configured to return the expanded, cooled fourth flow to the liquefied gas storage tank and further configured to send the heat-exchanged, expanded third flow to the compressor.

2. The apparatus according to claim 1, further comprising:

a pressure control line configured to discharge a fluid from the receiver for regulating a pressure inside the receiver, wherein the fluid discharged through the pressure control line is configured to be returned to the liquefied gas storage tank.

3. The apparatus according to claim 1, wherein the compressor is configured to compress the BOG discharged from the liquified gas storage tank to a pressure in the range of 40 to 100 bara.

4. The apparatus according to claim 1, wherein the BOG compressed by the compressor has a temperature of 80° C. to 130° C.

5. The apparatus according to claim 1, further comprising:

an after-cooler disposed downstream of the compressor and configured to cool the BOG compressed by the compressor, wherein the BOG cooled by the after-cooler has a temperature of 12° C. to 45° C.

6. The apparatus according to claim 1, wherein the BOG expanded by the first expansion unit has a pressure of 4 to 15 bara.

7. The apparatus according to claim 1, wherein the BOG expanded by the second expansion unit has a pressure of 2 to 5 bara.

8. The apparatus according to claim 1, wherein the compressor is a multistage compressor comprising multiple compressors, and each of the first flow having passed through the first intermediate cooler and the third flow having passed through the second intermediate cooler is supplied downstream of any one of the multiple compressors.

9. A method for reliquefying boil-off gas (BOG) generated in a liquefied gas storage tank provided to a vessel, the method comprising:

compressing, by a compressor, BOG generated from the liquefied gas;

cooling the compressed BOG using additional BOG generated from the liquefied gas;

dividing the cooled BOG into a first flow and a second flow;

expanding the first flow to provide an expanded first flow;

cooling the second flow using the expanded first flow to provide a cooled second flow;

supplying the cooled second flow to a receiver;

controlling a pressure downstream of the compressor by controlling a pressure of the receiver;

discharging BOG from the receiver for returning to the liquefied gas storage tank and controlling discharging of the BOG from the receiver to maintain an inner pressure of the receiver or the pressure of BOG downstream of the compressor at a preset pressure, dividing the BOG discharged from the receiver into at least two flows comprising a third flow and a fourth flow;

expanding the third flow to provide an expanded third flow;

cooling the fourth flow with the expanded third flow to provide a cooled forth flow; and supplying the cooled fourth flow to the liquified gas storage tank.

10. The method according to claim 9, wherein the pressure downstream of the compressor is set in the range of 40 to 100 bara.

11. The method according to claim 9, wherein the cooled fourth flow is expanded and supplied to the liquified gas storage tank and a level of the receiver is measured to regulate a degree of expansion of the cooled fourth flow.

12. The method according to claim 9, wherein the first flow is expanded to a pressure of 4 to 15 bara, the third flow is expanded to a pressure of 2 to 5 bara, and the expanded first flow and the expanded third flow are supplied to the compressor after cooling the second flow and the fourth flow, the third flow being supplied farther downstream of the compressor than the first flow.

13. The method according to claim 9, wherein the BOG compressed by the compressor is cooled to 12° C. to 45° C. before heat exchange with the BOG generated from the liquefied gas.

* * * * *